US008460048B2

(12) United States Patent
Iijima et al.

(10) Patent No.: US 8,460,048 B2
(45) Date of Patent: Jun. 11, 2013

(54) METHOD AND APPARATUS FOR MANUFACTURING PLASMA DISPLAY PANEL

(75) Inventors: Eiichi Iijima, Chigasaki (JP); Muneto Hakomori, Chigasaki (JP); Masato Nakatuka, Chigasaki (JP); Toshiharu Kurauchi, Tsukuba (JP)

(73) Assignee: Ulvac, Inc., Chigasaki-Shi (JP)

( * ) Notice: Subject to any disclaimer, the term of this patent is extended or adjusted under 35 U.S.C. 154(b) by 159 days.

(21) Appl. No.: 12/601,068

(22) PCT Filed: May 30, 2008

(86) PCT No.: PCT/JP2008/060025

§ 371 (c)(1),
(2), (4) Date: Nov. 20, 2009

(87) PCT Pub. No.: WO2008/152928

PCT Pub. Date: Dec. 18, 2008

(65) Prior Publication Data

US 2010/0167618 A1 Jul. 1, 2010

(30) Foreign Application Priority Data

Jun. 15, 2007 (JP) ..... P2007-158704

(51) Int. Cl.
*H01J 9/24* (2006.01)
*H01J 9/26* (2006.01)

(52) U.S. Cl.
USPC ..... 445/25; 445/24

(58) Field of Classification Search
None
See application file for complete search history.

(56) References Cited

U.S. PATENT DOCUMENTS

| | | | | |
|---|---|---|---|---|
| 4,018,490 | A * | 4/1977 | Berkenblit et al. | 445/25 |
| 5,093,571 | A * | 3/1992 | Inomata et al. | 250/288 |
| 6,533,630 | B1 | 3/2003 | Terajima et al. | |
| 6,769,946 | B1 | 8/2004 | Sasaki et al. | |
| 6,824,438 | B2 | 11/2004 | Park et al. | |
| 6,984,159 | B1 | 1/2006 | Kado et al. | |
| 2003/0077972 | A1 * | 4/2003 | Shiokawa et al. | 445/24 |
| 2004/0053555 | A1 | 3/2004 | Sasaki et al. | |
| 2006/0043897 | A1 | 3/2006 | Kosaka et al. | |

FOREIGN PATENT DOCUMENTS

| | | |
|---|---|---|
| EP | 1 276 129 | 1/2003 |
| JP | 2000-156160 | 6/2000 |
| JP | 3830288 | 6/2000 |
| JP | 2001-202887 | 7/2001 |
| SU | 234527 | 5/1969 |
| SU | 725117 | 3/1980 |

OTHER PUBLICATIONS

Search Report from corresponding EPO Application No. 08777036. 8-2208 dated Mar. 23, 2011.

(Continued)

*Primary Examiner* — Britt D Hanley
(74) *Attorney, Agent, or Firm* — Grossman, Tucker, Perreault & Pfleger, PLLC

(57) ABSTRACT

A method for manufacturing a plasma display panel in which an electrical discharge gas is introduced into a space between a first substrate and a second substrate which are sealed together, the method including: a first deaeration step of releasing impurity gases from a protective film by heating the first substrate, on which the protective film is formed for withstanding plasma electrical discharge, to 280° C. or more in a vacuum or in a controlled atmosphere; and a sealing step of sealing the front substrate, in which the impurity gases have been released from the protective film, and a rear substrate which are placed in contact with each other.

9 Claims, 15 Drawing Sheets

OTHER PUBLICATIONS

International Search Report from corresponding PCT Application No. PCT/JP2008/060025.
Notice of Allowance from corresponding Russian Application No. 2009146826 dated Aug. 4, 2011. English translation attached.

* cited by examiner

METHOD AND APPARATUS FOR MANUFACTURING PLASMA DISPLAY PANEL

TECHNICAL FIELD

The present invention relates to method and apparatus for manufacturing a plasma display panel.

Priority is claimed on Japanese Patent Application No. 2007-158704, filed Jun. 15, 2007, the contents of which are incorporated herein by reference.

BACKGROUND ART OF THE INVENTION

Conventionally, plasma display panels (referred to below as "PDP") are widely used in the field of display devices, and recently there have been demands for large-screen PDPs which have excellent quality but are low in cost.

PDPs are formed by laminating a front substrate and a rear substrate via a sealing material, and an electrical discharge gas is sealed thereinside. Three-electrode surface discharge technology is commonly used for PDPs in which sustaining electrodes and scanning electrodes are formed on the front substrate, and address electrodes are formed on the rear substrate. When voltage is applied between the scanning electrodes and the address electrodes so as to generate an electrical discharge, the sealed electrical discharge gas converted into plasma and ultraviolet rays are discharged. Phosphors which are formed on the rear substrate are excited by the ultraviolet rays resulting in visible light being discharged.

A process for manufacturing a PDP generally includes a step of forming a front substrate and a rear substrate separately (i.e., a front substrate step and a rear substrate step), and a step of laminating the two substrates together (i.e., a panel formation step). In the manufacturing process, during a period from when a protective film has been formed on the front substrate to protect it against plasma electrical discharge until the front substrate and rear substrate are laminated together, impurity gases such as $H_2$, $H_2O$, CO, $N_2$, and $CO_2$ may be adsorbed by the protective film. If these impurity gases are adsorbed to the protective film, there is a resulting reduction in the secondary electron discharge coefficient of the protective film. As a result, there is a possibility of the discharge voltage of the PDP increasing. In view of this, in the sealing step to seal together the two substrates, an exhaust pipe is attached and the interior of the panel is purified (i.e., dried) by heating and evacuating (i.e., by means of vacuum baking). Moreover, aging (i.e., pre-conditioning) is also performed by applying AC voltage to the electrical discharge gas after it has been introduced so as to generate an electrical discharge, and to then reduce the discharge voltage of the panel so as to stabilize the electrical discharge characteristics (see, for example, Patent document 1).

[Patent document 1] Japanese Patent Publication No. 3830288

DISCLOSURE OF THE INVENTION

Problems to be Solved by the Invention

However, the above described purification is performed after the two substrates have been sealed together where the exhaust conductance via the exhaust pipe is extremely small. In the future, as PDP advance towards even more refined microstructures, there will be an even further reduction in exhaust conductance. Because of this, several hours (i.e., 2 to 6 hours) are required for the purification. Moreover, 3 to 15 hours are required for the aging. Namely, the problem arises that there is a reduction in throughput in the panel formation step.

In contrast, among the front substrate step, the throughput in the protective film formation step has become quicker as a result of improvements in the film formation rate and the enlargement of the film formation device. Here, in order to make the throughput of the entire PDP manufacturing line the same as that of the protective film formation step, a number of sealing and aging apparatuses are required. In this case, there is an increased level of energy consumption which is a sizable problem for reducing costs for manufacturing PDPs.

The present invention was conceived in order to solve the above described problem, and it is an object thereof to provide method and apparatus for manufacturing a plasma display panel which make it possible to achieve an improvement in throughput and energy efficiency.

Means for Solving the Problem

In order to achieve the above described object, the present invention employs the following. In particular, an aspect of the present invention is a method for manufacturing a plasma display panel in which an electrical discharge gas is introduced into a space between a first substrate and a second substrate which are sealed together, the method including: a first deaeration step of releasing impurity gases from a protective film by heating the first substrate, on which the protective film is formed for withstanding plasma electrical discharge, to 280° C. or more in a vacuum or in a controlled atmosphere; and a sealing step of sealing the front substrate, in which the impurity gases have been released from the protective film, and a rear substrate which are placed in contact with each other.

According to the above described method for manufacturing a plasma display panel, since impurity gases are released from a protective film while the exhaust conductance is large prior to the front substrate and rear substrate being placed in contact with each other, it is possible to perform purification in a short time. Moreover, since the protective film is heated to 280° C. or more, it is possible to release approximately 70% or more of the impurity gases absorbed in the protective film (see FIG. 6). That is to say, it is possible to lower the content of impurity gases within a sealed panel. Therefore, it is possible to stabilize the discharge voltage of a panel, and thus to achieve either a reduction of the amount of the aging time or else to eliminate the aging step altogether. Accordingly, it becomes possible to improve throughput and achieve an improvement in energy efficiency in manufacturing plasma display panels.

It may be arranged such that the method further includes a protective film formation step of forming the protective film on the first substrate either in a vacuum or in a controlled atmosphere prior to the first deaeration step, wherein the first substrate is held in the vacuum or in the controlled atmosphere from the protective film formation step through the first deaeration step.

In this case, it is possible to suppress the absorption of impurity gases into the protective film, and thus improve throughput and achieve an improvement in energy efficiency in manufacturing plasma display panels.

It may be arranged such that the method further includes a preliminary deaeration step of releasing impurity gases from the protective film by heating the first substrate, on which the protective film is formed, to 350° C. or more in a vacuum prior to the first deaeration step, wherein the first substrate is held in the vacuum from the preliminary deaeration step through the first deaeration step.

In this case, by heating the first substrate to 350° C. or more, it becomes possible to release any impurity gases which are absorbed during the formation of the protective film, and it is also possible to suppress the absorption of any new impurity gases while the first substrate is left in a waiting state. Therefore, it is possible to either reduce the amount of the aging time or else eliminate the aging step altogether as well as reduce the amount of the purification time. As a result, it is possible to improve throughput and achieve an improvement in energy efficiency in manufacturing plasma display panels. Moreover, since the first substrate can be left in a waiting state between the protective film formation step and the sealing step, flexible step design becomes possible. As a result, even more improved throughput can be achieved in manufacturing plasma display panels.

It may be arranged such that the method further includes a preliminary deaeration step of releasing impurity gases from the protective film by heating the first substrate, on which the protective film has been formed, to 350° C. or more in an air atmosphere or in a controlled atmosphere prior to the first deaeration step.

In this case, since the first substrate is heated either in an air atmosphere or in a controlled atmosphere, it is not necessary for the first substrate to be held in a vacuum from the protective film formation step through to the completion of the sealing step. For this reason, flexible step design becomes possible which results in improving throughput in manufacturing plasma display panels.

It may be arranged such that the sealing step is performed while the density of impurity gases in the atmosphere is held at a predetermined value or less.

In this case, it is possible to lower the content of impurity gases within a panel after the sealing step. For this reason, it is possible to either reduce the amount of the aging time or else eliminate the aging step altogether. As a result, it is possible to improve throughput and achieve an improvement in energy efficiency in manufacturing plasma display panels.

It may be arranged such that, in the first deaeration step, when the first substrate and the second substrate are positioned facing each other, a carrier gas is introduced between the first substrate and the second substrate such that a mean free path of the impurity gas released from either the first substrate or the second substrate is shorter than the gap between the first substrate and the second substrate.

In this case, it is possible to prevent the impurity gases released from either one of the first and second substrates from entering into the other one of the first and second substrates. For this reason, it is possible to either reduce the amount of the aging time or else eliminate the aging step altogether. As a result, it is possible to improve throughput and achieve an improvement in energy efficiency in manufacturing plasma display panels.

It may be arranged such that the carrier gas is the same type of gas as the electrical discharge gas.

In this case, since it is not necessary to provide a separate carrier gas supply device, it is consequently possible to reduce manufacturing costs.

It may be arranged such that the method further includes a second deaeration step of releasing impurity gases from phosphors and a sealing material by heating the second substrate, on which the phosphors and the sealing material are placed, in a vacuum or in a controlled atmosphere prior to the sealing step.

In this case, it is possible to lower the quantity of impurity gases absorbed into the phosphors and sealing material. Accordingly, it is possible to either reduce the amount of the aging time or else eliminate the aging step altogether. As a result, it is possible to improve throughput and achieve an improvement in energy efficiency in manufacturing plasma display panels.

It may be arranged such that the method further includes a sealing material coating step of applying a sealing material onto the second substrate either in a vacuum or in a controlled atmosphere prior to the second deaeration step, wherein the second substrate is held in the vacuum or in the controlled atmosphere from the sealing material coating step through the second deaeration step.

In this case, it is possible to lower the quantity of impurity gases absorbed into the sealing material even further. Accordingly, it is possible to either reduce the amount of the aging time or else eliminate the aging step altogether. As a result, it is possible to improve throughput and achieve an improvement in energy efficiency in manufacturing plasma display panels.

It may be arranged such that, in the sealing step, the electrical discharge gas is introduced such that the partial pressure of the impurity gases is 2.0 Pa or less.

In this case, it is possible to lower the content of impurity gases within a panel which has been sealed. For this reason, it is possible to stabilize the discharge voltage of a plasma display panel, and thereby achieve either a reduction of the amount of the aging time or else to eliminate the aging step altogether. Accordingly, it becomes possible to improve throughput and achieve an improvement in energy efficiency in manufacturing plasma display panels.

It may be arranged such that the method further includes a step of preliminary heating the first substrate and the second substrate in a vacuum or in a controlled atmosphere to a temperature equal to or greater than the sealing temperature in the sealing step, prior to the sealing step.

In this case, it is possible to lower the quantity of impurity gases absorbed into the first substrate and second substrate even further. Accordingly, it is possible to either reduce the amount of the aging time or else eliminate the aging step altogether. As a result, it is possible to improve throughput and achieve an improvement in energy efficiency in manufacturing plasma display panels.

Moreover, an apparatus for manufacturing a plasma display panel according to the present invention is provided with a sealing chamber in which a first substrate and a second substrate are sealed together either in a vacuum or in a controlled atmosphere, wherein the sealing chamber is configured such that, prior to the first substrate and the second substrate being placed in contact with each other, the first substrate on which a protective film is formed for withstanding plasma electrical discharge is heated to 280° C. or more either in a vacuum or in a controlled atmosphere.

According to the above described apparatus for manufacturing a plasma display panel, since the protective film is heated prior to the first substrate and second substrate being placed in contact with each other so that impurity gases are released from the protective film, purification can be performed in a short period of time. Moreover, since the deaeration of the protective film and the sealing together of the two substrates can be consecutively performed in the film formation chamber, it is possible to lower the content of impurity gases within a sealed panel. For this reason, since the discharge voltage of a plasma display panel can be stabilized, it is possible to achieve either a reduction of the amount of the aging time or else to eliminate the aging step altogether.

Accordingly, it becomes possible to improve throughput and achieve an improvement in energy efficiency in manufacturing plasma display panels.

It may be arranged such that the apparatus further includes a film formation chamber in which the protective film is formed on the first substrate, wherein the first substrate is held in the vacuum or in the controlled atmosphere from the film formation chamber through the sealing chamber.

In this case, since any absorption of impurity gases into the protective film can further be suppressed, the content of impurity gases within a sealed panel can be lowered. Accordingly, it becomes possible to improve throughput and achieve an improvement in energy efficiency in manufacturing plasma display panels.

It may be arranged such that the apparatus further includes a heating chamber in which the second substrate on which phosphors and a sealing material are placed is heated either in a vacuum or in a controlled atmosphere, wherein the second substrate is held in the vacuum or in the controlled atmosphere from the heating chamber through to the sealing chamber.

In this case, since any absorption of impurity gases into the phosphors and sealing material of the second substrate can be suppressed, the content of impurity gases in a panel which has been sealed can be lowered. Accordingly, it is possible to either reduce the amount of the aging time or else eliminate the aging step altogether. As a result, it is possible to improve throughput and achieve an improvement in energy efficiency in manufacturing plasma display panels.

It may be arranged such that the apparatus further includes a coating chamber in which a coating material is applied onto the second substrate either in a vacuum or in a controlled atmosphere, wherein the second substrate is held in the vacuum or in the controlled atmosphere from the coating chamber through the heating chamber and to the sealing chamber.

In this case, since any absorption of impurity gases into sealing material can further be suppressed, the content of impurity gases in a panel which has been sealed can be lowered. Accordingly, it is possible to improve throughput and achieve an improvement in energy efficiency in manufacturing plasma display panels.

It may be arranged such that the sealing chamber is provided with a gas analyzer which is capable of measuring the density of impurity gases in the atmosphere.

In this case, by monitoring the density of impurity gases in the sealing chamber, the content of impurity gases in a panel which has been sealed can be lowered. For this reason, it is possible to achieve either a reduction of the amount of the aging time or else to eliminate the aging step altogether. Accordingly, it becomes possible to improve throughput and achieve an improvement in energy efficiency in manufacturing plasma display panels.

It may be arranged such that the sealing chamber is configured such that, prior to the first substrate and the second substrate being placed in contact with each other, the first substrate and the second substrate are preliminary heated either in a vacuum or in a controlled atmosphere to a temperature equal to or greater than the sealing temperature.

In this case, the sealing can be performed with the quantity of impurity gases absorbed into the first substrate and second substrate lowered even further. Accordingly, it is possible to either reduce the amount of the aging time or else eliminate the aging step altogether. As a result, it is possible to improve throughput and achieve an improvement in energy efficiency in manufacturing plasma display panels.

Advantageous Effects of the Invention

With the method of manufacturing a plasma display panel according to the present invention, since impurity gases are released from a protective film while the exhaust conductance is large prior to the front substrate and rear substrate being placed in contact with each other, it is possible to perform purification in a short time, and it is not necessary for purification to be performed during the sealing step. Moreover, since the protective film is heated to 280° C. or more, it is possible to release the majority of the impurity gases absorbed in the protective film. Namely, it is possible to lower the content of impurity gases within a sealed panel. For this reason, it is possible to stabilize the discharge voltage of a panel, and thereby achieve either a reduction of the amount of the aging time or else to eliminate the aging step altogether. Accordingly, it becomes possible to improve throughput and achieve an improvement in energy efficiency in manufacturing plasma display panels.

Moreover, based on the apparatus for manufacturing a plasma display panel according to the present invention, since the protective film is heated prior to the first substrate and second substrate being placed in contact with each other so that impurity gases are released from the protective film, purification can be performed in a short period of time. Moreover, since the deaeration of the protective film and the sealing together of the two substrates can be consecutively performed in the film formation chamber, it is possible to lower the content of impurity gases within a panel which has been sealed. For this reason, the discharge voltage of a plasma display panel can be stabilized, it is possible to achieve either a reduction of the amount of the aging time or else to eliminate the aging step altogether. Accordingly, it becomes possible to improve throughput and achieve an improvement in energy efficiency in manufacturing plasma display panels.

DESCRIPTION OF THE REFERENCE SYMBOLS

Figure 1:
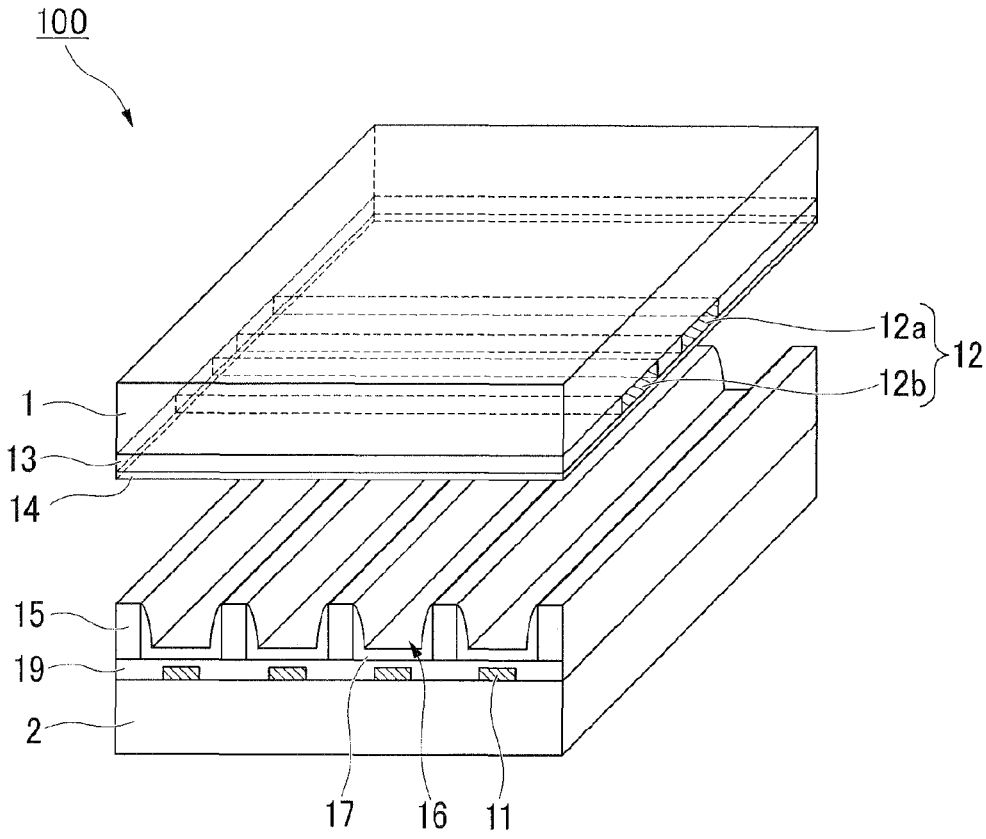
FIG. 1 is an exploded perspective view showing a three-electrode AC type plasma display panel.

1 Front substrate (First substrate)
2 Rear substrate (First substrate)
14 Protective film
17 Phosphor
20 Sealing material
50 Plasma display panel manufacturing apparatus
64 Film formation chamber
82 Sealing chamber
96 Residual gas analyzer (gas analysis device)
100 Plasma display panel
S66 Protective film formation step
S78 Sealing material coating step
S84 Sealing step
S801 First deaeration step
S802 Second deaeration step

BEST MODE FOR CARRYING OUT THE INVENTION

Embodiments of the present invention will now be described with reference to the drawings. It should be noted that in the respective drawings referred to in the following description, the scale of the respective components are adequately changed so as be drawn in a recognizable dimension. In addition, in the following description, the 'inner face' of a substrate shall be the surface facing the other substrate.

(Plasma Display Panel)

FIG. 1 is an exploded perspective view of a three-electrode AC type plasma display panel. The plasma display panel (hereinafter referred to as "PDP") 100 is provided with a front substrate (i.e., a first substrate) 1 and a rear substrate (i.e., a second substrate) 2 which are arranged so as to face each other and a plurality of electrical discharge chambers 16 which are formed between the substrates 1 and 2.

Display electrodes 12 (i.e., scanning electrodes 12*a* and sustaining electrodes 12*b*) are formed in a stripe pattern at predetermined intervals on the inner face of the front substrate 1. The display electrodes 12 are formed by a transparent conductive material such as ITO and bus electrodes. A dielectric layer 13 is formed so as to cover the display electrodes 12, and a protective film 14 is formed so as to cover the dielectric layer 13. The protective film 14 protects the dielectric layer 13 from positive ions which are generated through the conversion of the discharge gas into plasma, and is formed by an oxide of an alkaline earth metal such as MgO and SrO.

In contrast, address electrodes 11 are formed in a stripe pattern at predetermined intervals on the inner face of the rear substrate 2. The address electrodes 11 are arranged so as to be perpendicular to the display electrodes 12. Intersection points between the address electrodes 11 and the display electrodes 12 form pixels of the PDP 100.

A dielectric layer 19 is formed so as to cover the address electrodes 11. In addition, partition walls (i.e., ribs) 15 are formed in parallel with the address electrodes 11 on the top surface of the dielectric layer 19 between mutually adjacent address electrodes 11. Further, phosphors 17 are placed on the top face of the dielectric layer 19 between mutually adjacent partition walls 15 and on the side faces of the partition walls 15. The phosphors 17 emit any one of red, green, or blue fluorescence.

Figure 2A:
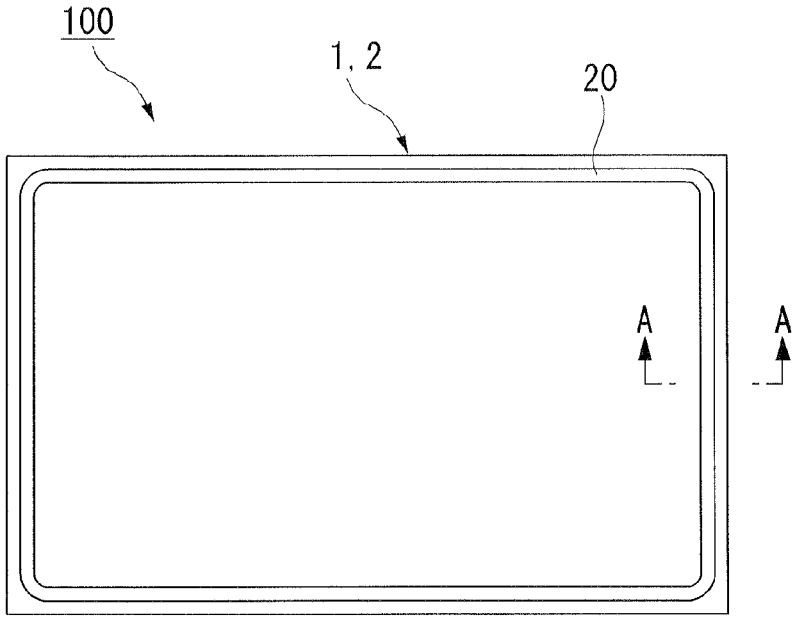
FIG. 2A is a plan view of a PDP.

FIG. 2A is a plan view of a PDP. The above described front substrate 1 and rear substrate 2 are laminated together by means of a sealing material 20 which is placed on peripheral edge portions of the inner faces of the substrates.

Figure 2B:
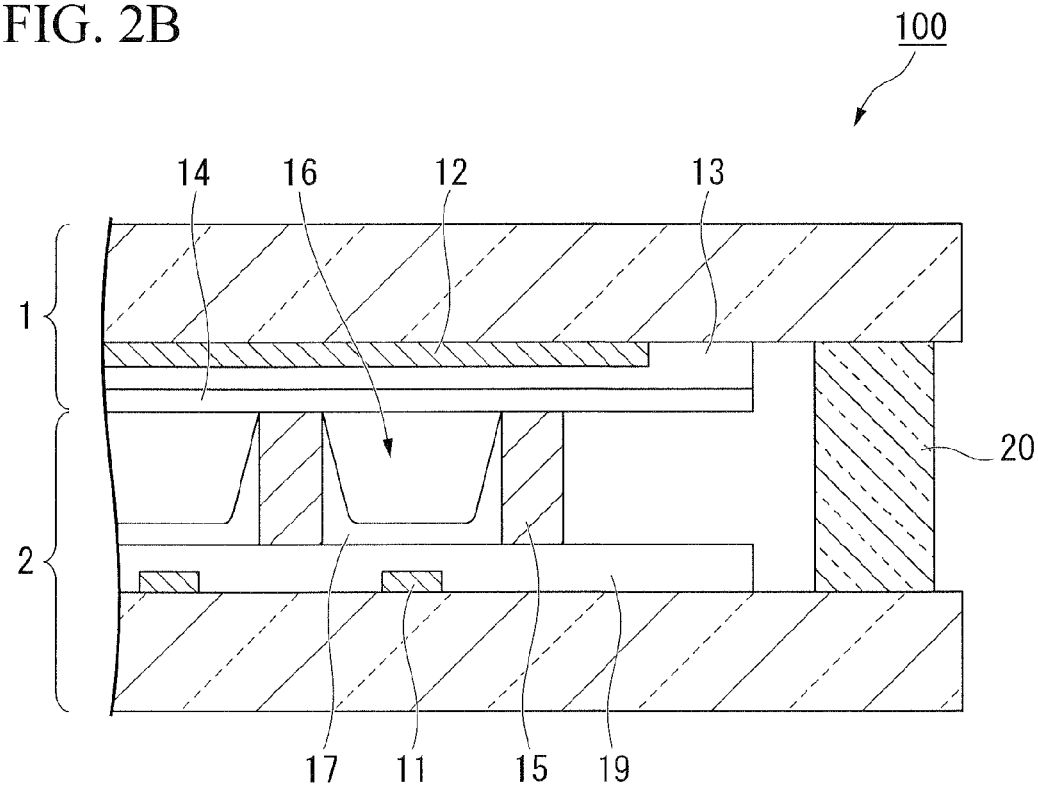
FIG. 2B is a side cross-sectional view taken along a line A-A in FIG. 2A.

FIG. 2B is a side cross-sectional view taken along a line A-A in FIG. 2A. As is shown in FIG. 2B, as a result of the front substrate 1 and the rear substrate 2 being laminated together, electrical discharge chambers 16 are formed between mutually adjacent partition walls 15. Electrical discharge gas such as a mixture of Ne and Xe gases is sealed inside the electrical discharge chambers 16.

By applying direct current voltage between the address electrodes 11 and the scanning electrodes 12*a* of the PDP 100, counter discharge is generated. Further, by applying alternating current voltage between the scanning electrodes 12*a* and the sustaining electrodes 12*b*, surface discharge is generated. As a result, plasma is generated from the electrical discharge gas sealed inside the electrical discharge chambers 16, and vacuum ultraviolet rays are emitted. The phosphors 17 are excited by the ultraviolet light and thus visible light is emitted from the front substrate 1.

(PDP Manufacturing Method and Manufacturing Apparatus)

Figure 3:
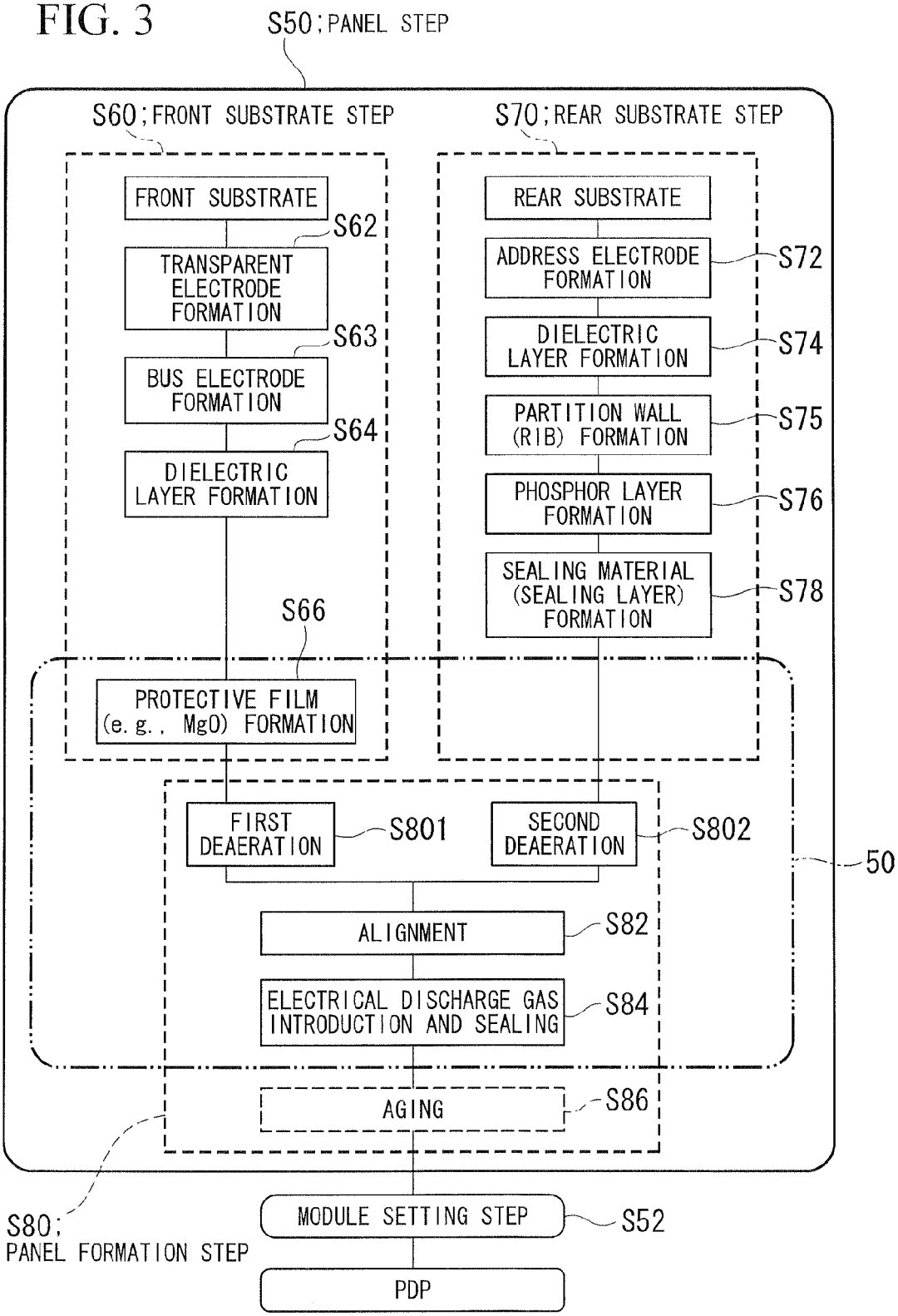
FIG. 3 is a flowchart of a PDP manufacturing method according to a first embodiment of the present invention.

FIG. 3 is a flowchart showing the method for manufacturing a PDP according to a first embodiment of the present invention. The PDP manufacturing process is broadly divided into two steps, namely, a panel step (S50) and a module setting step (S52). The panel step (S50) is divided into a front substrate step (S60), a rear substrate step (S70), and a panel formation step (S80).

In the front substrate step (S60), firstly, the transparent electrodes used for the display electrodes 12 are formed on the front substrate 1 (S62). Specifically, a transparent conductive film such as ITO or $SnO_2$ is formed on the front substrate 1 using a sputtering method or the like, and patterning is then performed on the transparent conductive film so as to form the display electrodes 12. Next, in order to reduce the electrical resistance of the obtained display electrodes 12, auxiliary electrodes (i.e., bus electrodes) are formed on the display electrodes 12 from a metal material using a sputtering method (S63). Further, a dielectric layer 13 having a thickness of 20 to 40 μm is formed on these electrodes using a printing method or the like in order to protect these display electrodes 12 and auxiliary electrodes and to form a wall charge, and is then baked (S64). Next, in order to protect the formed dielectric layer 13 and improve the secondary electron discharge efficiency, a protective film 14 having a thickness of 700 to 1200 nm is formed on the dielectric layer 13 using an electron beam evaporation method (S66).

In the rear substrate formation step (S70), address electrodes 11 which are made of Ag, Cr/Cu/Cr, or Al are firstly formed on the rear substrate 2 (S72). Next, a dielectric layer 19 is formed on the address electrodes 11 in order to protect the formed address electrodes 11 (S74). Further, a plurality of partition walls 15 are formed on the dielectric layer 19 using a sand-blasting method or the like in order to increase the electrical discharge space and the light emission surface area of the phosphors 17 (S75). A sand-blasting method involves applying a glass paste which is used as the material for forming the partition walls onto the substrate, drying the applied glass paste and then patterning a mask material thereon, and then blasting the substrate with a polishing agent such as alumina or glass beads at high pressure to form a plurality of partition walls having a predetermined shape. Next, the phosphors 17 are applied between mutually adjacent partition walls 15 using a screen printing method or the like, and are then dried. Thereafter, the dried phosphors 17 are baked at approximately 500° C. (S76). Next, the sealing material 20 is applied onto peripheral edges of the rear substrate 2 while the rear substrate 2 is being heated (S78).

Figure 4:
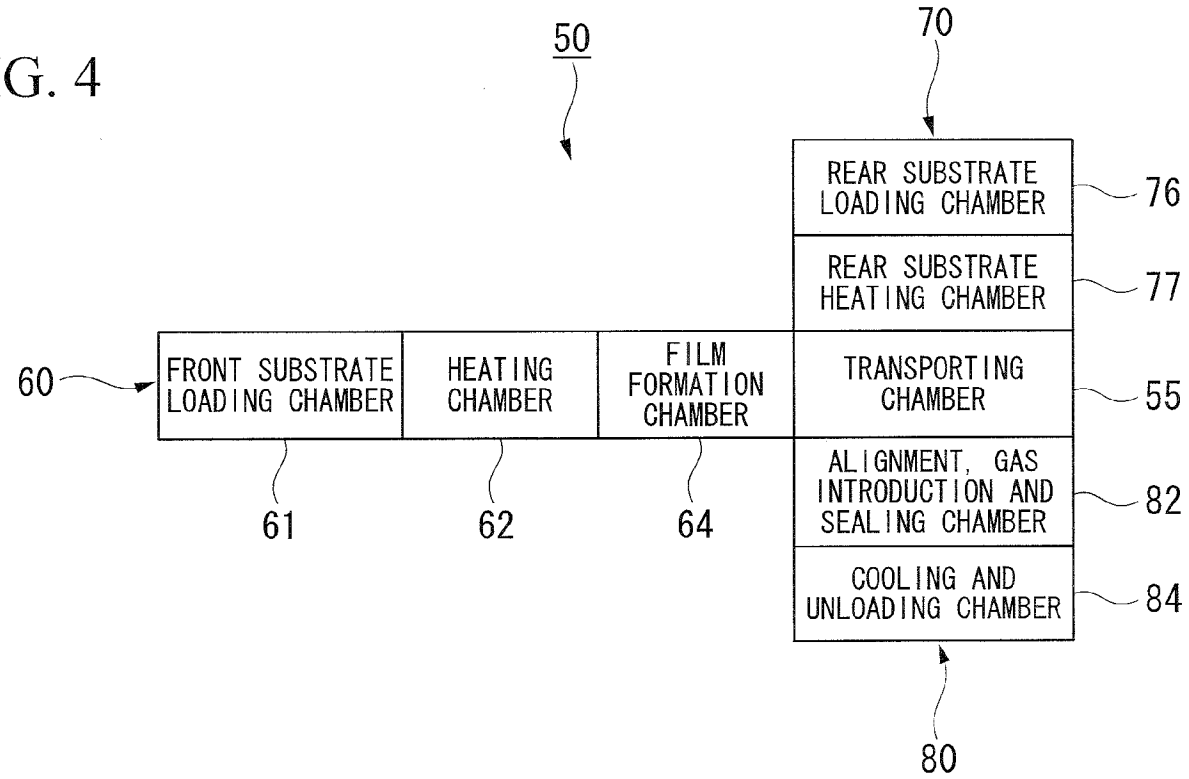
FIG. 4 is a block diagram showing a PDP manufacturing apparatus according to the first embodiment.

FIG. 4 is a block diagram showing the apparatus for manufacturing a PDP according to the first embodiment of the present invention. In the PDP manufacturing apparatus 50, a rear end of a front substrate line 60, a rear end of a rear substrate line 70, and a front end of a panel formation line 80 are each connected to a transporting chamber 55. The PDP manufacturing apparatus 50 continuously performs the tasks within a area 50 which is encompassed by the double-dot chain line in the PDP manufacturing process shown in FIG. 3 in a vacuum or in a controlled atmosphere. In addition, since the tact time required for the protective film formation step in the front substrate line 60 shown in FIG. 4 is much shorter compared to the tact time required for the panel formation step in the panel formation line 80, a plurality of panel formation lines 80 may be connected to the single front substrate line 60.

The front substrate line 60 is provided with a loading chamber (i.e., an evacuating chamber) 61 which receives the front substrate 1 which having just completed the dielectric layer 13 formation step, a heating chamber 62 which heats the front substrate 1 to approximately 150 to 350° C., and a film formation chamber 64 which forms the protective film 14 using an electron beam evaporation method as shown in FIG. 4. It is noted that the front substrate can be kept in a vacuum or in a controlled atmosphere from the film formation chamber 64 to the sealing chamber 82 (described below). In the present embodiment, the front substrate 1 is heated to 250° C., and an MgO film is then formed on the surface thereof to a thickness of approximately 800 nm so as to form the protective film 14.

The rear substrate line 70 is provided with a loading chamber 76 which receives the rear substrate 2 on which the phosphors 17 and sealing material 20 are formed, and a heating chamber 77 which heats the rear substrate 2. It is noted that the rear substrate can be kept in a vacuum or in a controlled atmosphere from the heating chamber 77 to the sealing chamber 82 (described below). In the heating chamber 77, a second deaeration step (S802) is performed as shown in FIG. 3. In the step, the rear substrate 2 is heated to release impurity gas from the phosphors and sealing material. More specifically, the rear substrate 2 is heated at approximately 450° C. for around 3 hours in the heating chamber 77 into which $N_2$ gas and $O_2$ gas is being introduced while the inside of the heating chamber 77 is kept at approximately 200 Pa. It may be arranged such that the rear substrate 2 is heated at 420 to 430° C. for around 3 hours in the heating chamber 77 while the inside of the heating chamber 77 is kept at approximately $10^{-5}$ Pa by evacuating. A plurality of the rear substrate 2 may be heated at the same time, a plurality of heating chamber may be provided, or a combination of these two may be employed in order to improve throughput in the rear substrate line 70.

On the other hand, the panel formation line 80 is provided with a sealing chamber 82 in which alignment of the front substrate 1 and rear substrate 2, introduction of an electrical discharge gas, and sealing between the front substrate 1 and rear substrate 2 are performed as shown in FIG. 4. As such, since the steps from the alignment to the sealing for the front substrate 1 and rear substrate 2 are performed in the same chamber, it is possible to suppress absorption of impurity gases onto both substrates. For this reason, it is possible to either reduce the amount of the aging time or else eliminate the aging step altogether as well as reduce the amount of the purification time.

Figure 5:
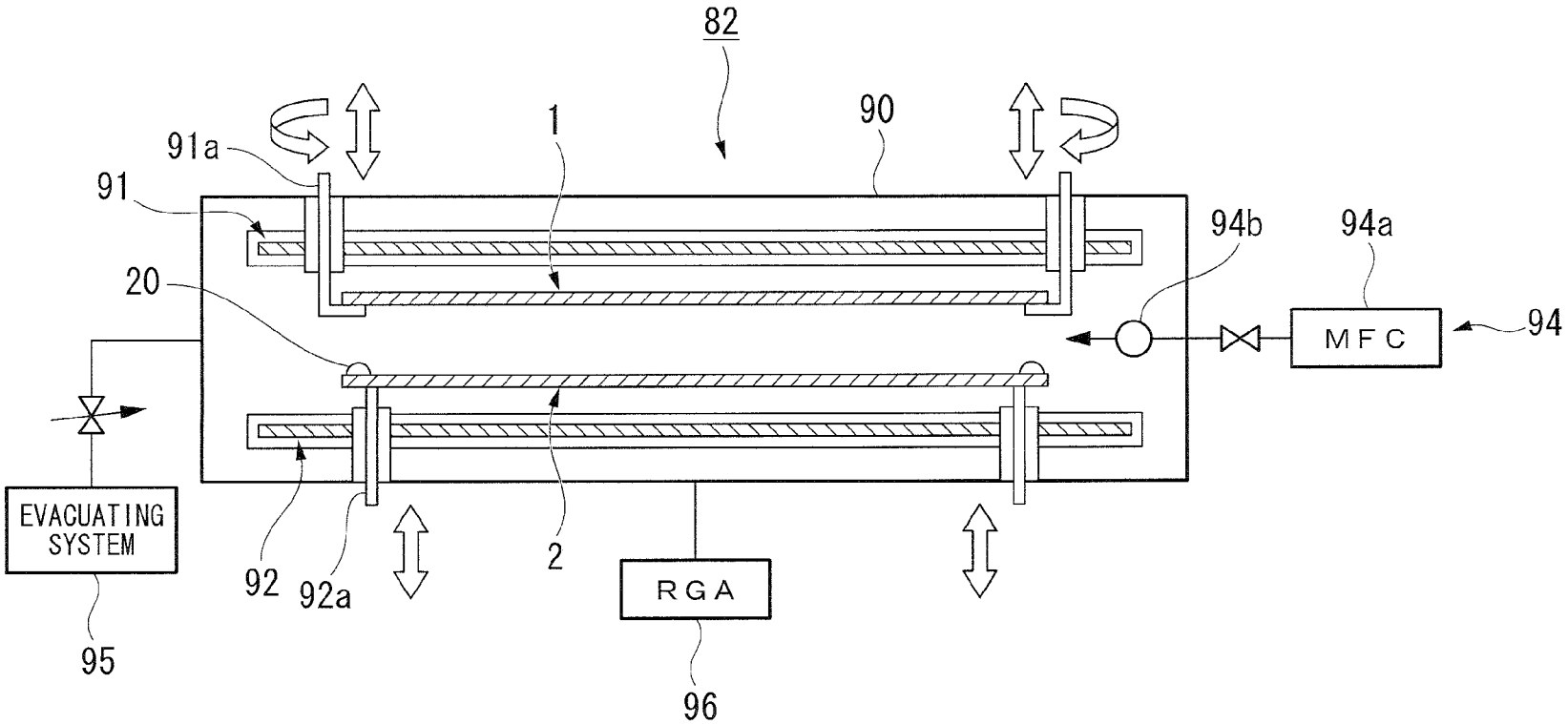
FIG. 5 is a schematic block diagram showing a sealing chamber.

FIG. 5 is a schematic block diagram showing a sealing chamber. The sealing chamber is provided with a camber 90 being capable of resisting against vacuum or a pressure of 19.6 N/cm$^2$G. A top face of the chamber 90 is provided with a plurality of hook mechanism 91*a* for supporting the front substrate 1. For heating the front substrate 1 supported by the hook mechanism 91*a*, a heater plate 91 is provided so as to be substantially parallel to the top face of the chamber 90. Meanwhile, a bottom face of the chamber 90 is provided with a plurality of pin mechanism 92*a* for supporting the rear substrate 2. For heating the rear substrate 2 supported by the pin mechanism 92*a*, a heater plate 92 is provided so as to be substantially parallel to the bottom face of the chamber 90. Instead of heating the two substrates using radiant heat as is described above, the two substrates may be supported using an electrostatic chuck mechanism or the like, and then heated by means of heat transfer in a contact manner or heat transfer via a gas.

An electrical discharge gas supply device 94 is provided in one lateral face of the chamber 90. The electrical discharge gas supply device 94 is provided with a mass flow controller (MFC) 94*a*, and a gas nozzle 94*b* which opens towards a central portion of the chamber 90. Moreover, an evacuating system 95 which is formed by a turbo-molecular pump or the like is provided on the other lateral face of the chamber 90. It is noted that a variable conductance valve may be provided in the evacuating system 95 in order to enable the exhaust rate to be adjusted.

A residual gas analyzer (RGA) 96 is provided in the chamber 90. This residual gas analyzer and 96 is formed by a quadrupole mass spectrometer or the like. It is noted that the quadrupole mass spectrometer does not operate unless the pressure is equal to or less than a predetermined pressure. Therefore, a differential evacuating system, gas introduction capillary and the like are provided in order to decompress the gas to be measured, which is introduced into the analyzer tube of the quadrupole mass spectrometer, to a predetermined pressure.

It is also noted that a vacuum gauge (not shown) is mounted in the chamber 90. A CCD camera mechanism is also provided on the open air side of the chamber 90 for aligning the two substrates.

The panel formation step (S80) shown in FIG. 3 is performed in the above described sealing chamber 82.

In the panel formation step (S80), a first deaeration step (S801) is performed in which impurity gases are released from the protective film by heating the front substrate 1. Further, an alignment step (S82) to align the two substrates, and an electrical discharge gas introduction and sealing step (S84) are performed. It is noted that, if necessary, an aging step (S86) is performed for a short period of time.

Specifically, firstly, any gas inside the sealing chamber 82 is exhausted by the evacuating system 95, and the interior of the sealing chamber 82 is then kept in a vacuum or in a controlled atmosphere. Next, a front substrate 1 on which a protective film 14 has been formed is transported to the sealing chamber 82 while being kept in a vacuum or in a controlled atmosphere, and is supported by the hook mechanism 91*a* provided in a top portion of the sealing chamber 82. Next, the front substrate 1 is heated in the vacuum or in the controlled atmosphere to a temperature of 280° C. or greater using the heater plate 91, so that the impurity gases are released from the protective film (first deaeration step; S801).

Figure 6:
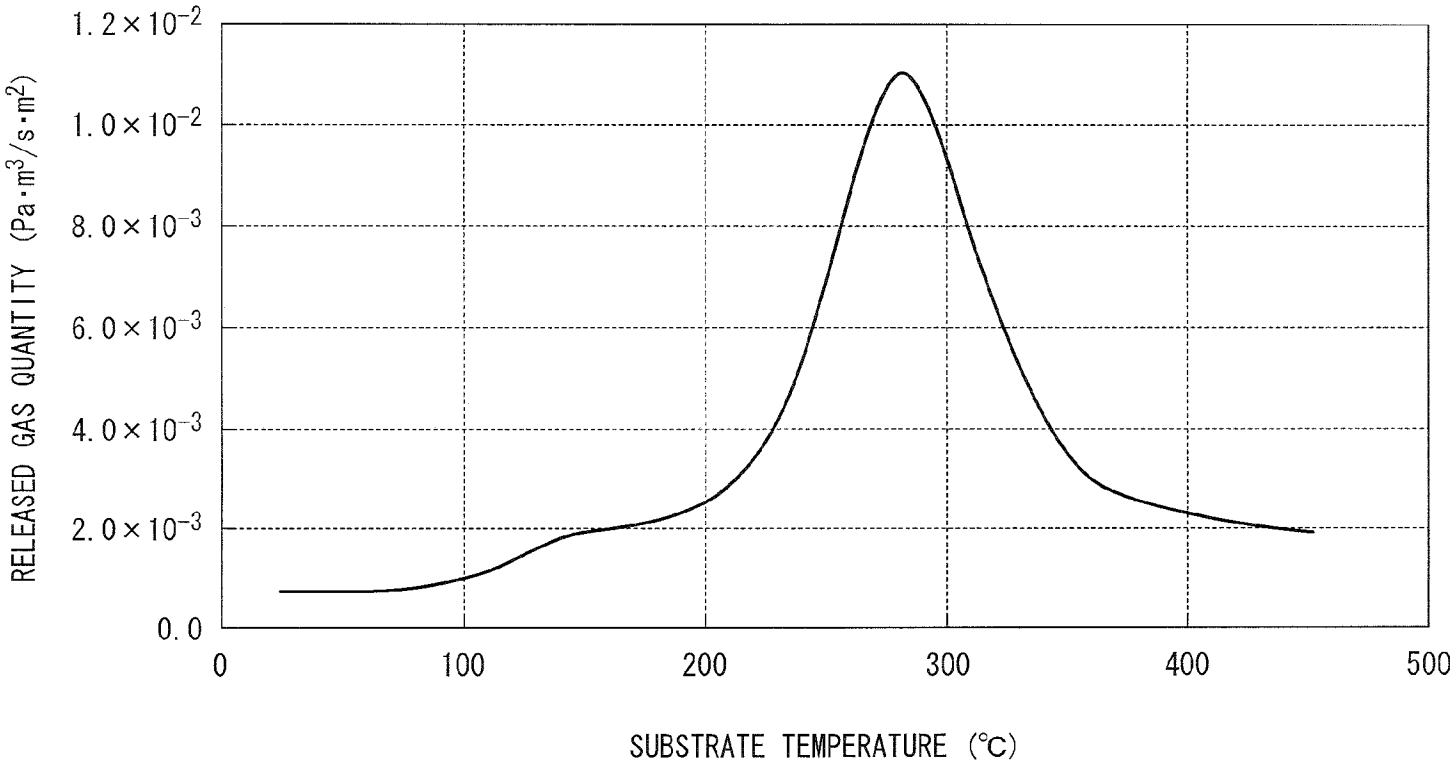
FIG. 6 is a graph showing measurement results of a quantity of released gas from a protective film due to heating.

FIG. 6 is a graph showing the measurement results of the quantity of gas released from the protective film due to heating. The temperature of the heated front substrate 1 is shown on the horizontal axis, while the quantity of released gas is shown on the vertical axis. The inventors of the present invention formed a protective film having a thickness of approximately 800 nm from MgO at a film formation pressure of $5\times10^{-2}$ Pa, and measured the quantity of released gas from the protective film using thermal desorption spectroscopy (TDS). As a result, as is shown in FIG. 6, it was found that a small peak in the released gas quantity was present at approximately 140° C., and a large peak in the released gas quantity was present at approximately 280° C.

Figure 7:
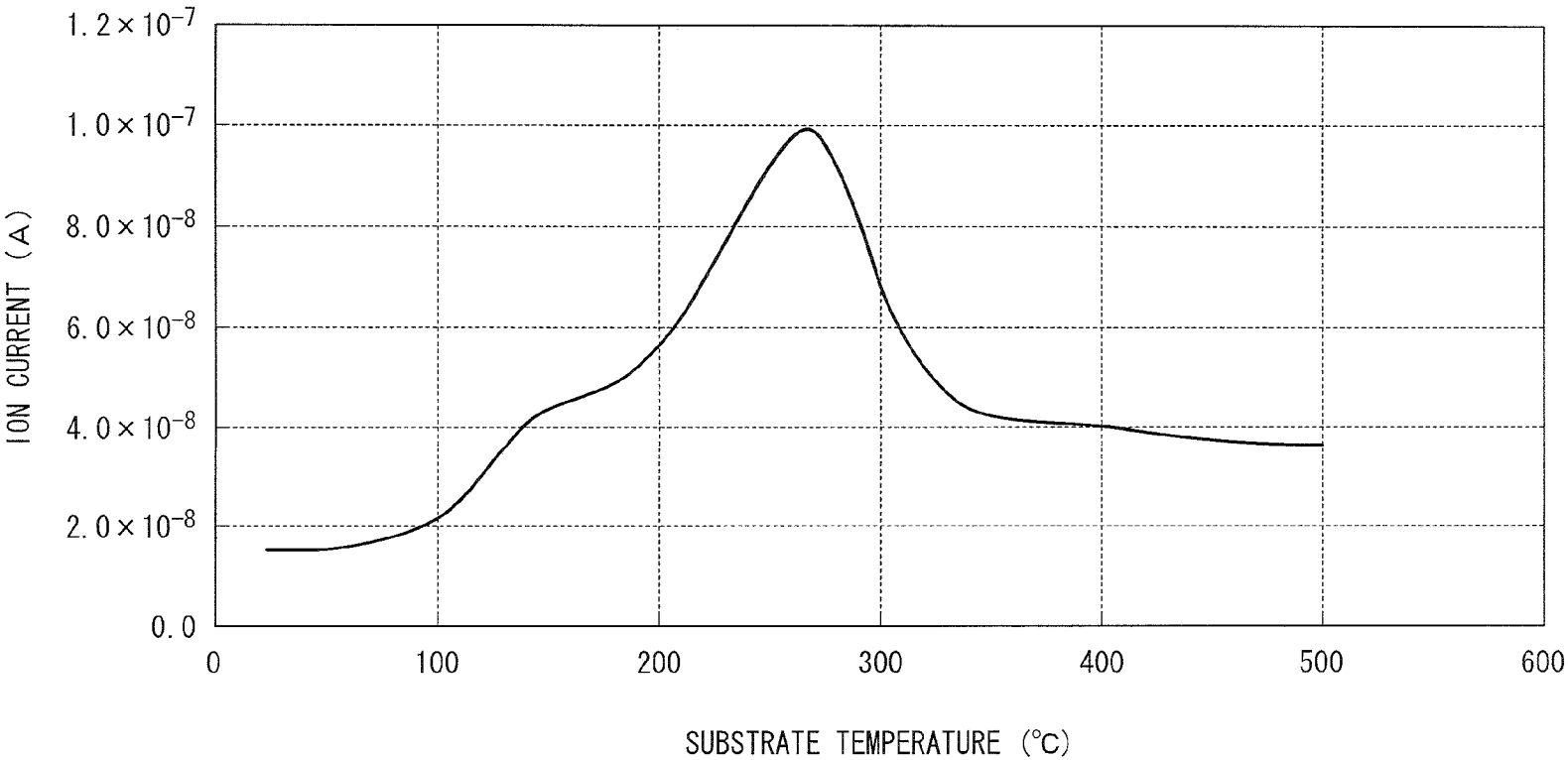
FIG. 7 is a graph showing an ion current value of water while heating a front substrate.
Figure 8:
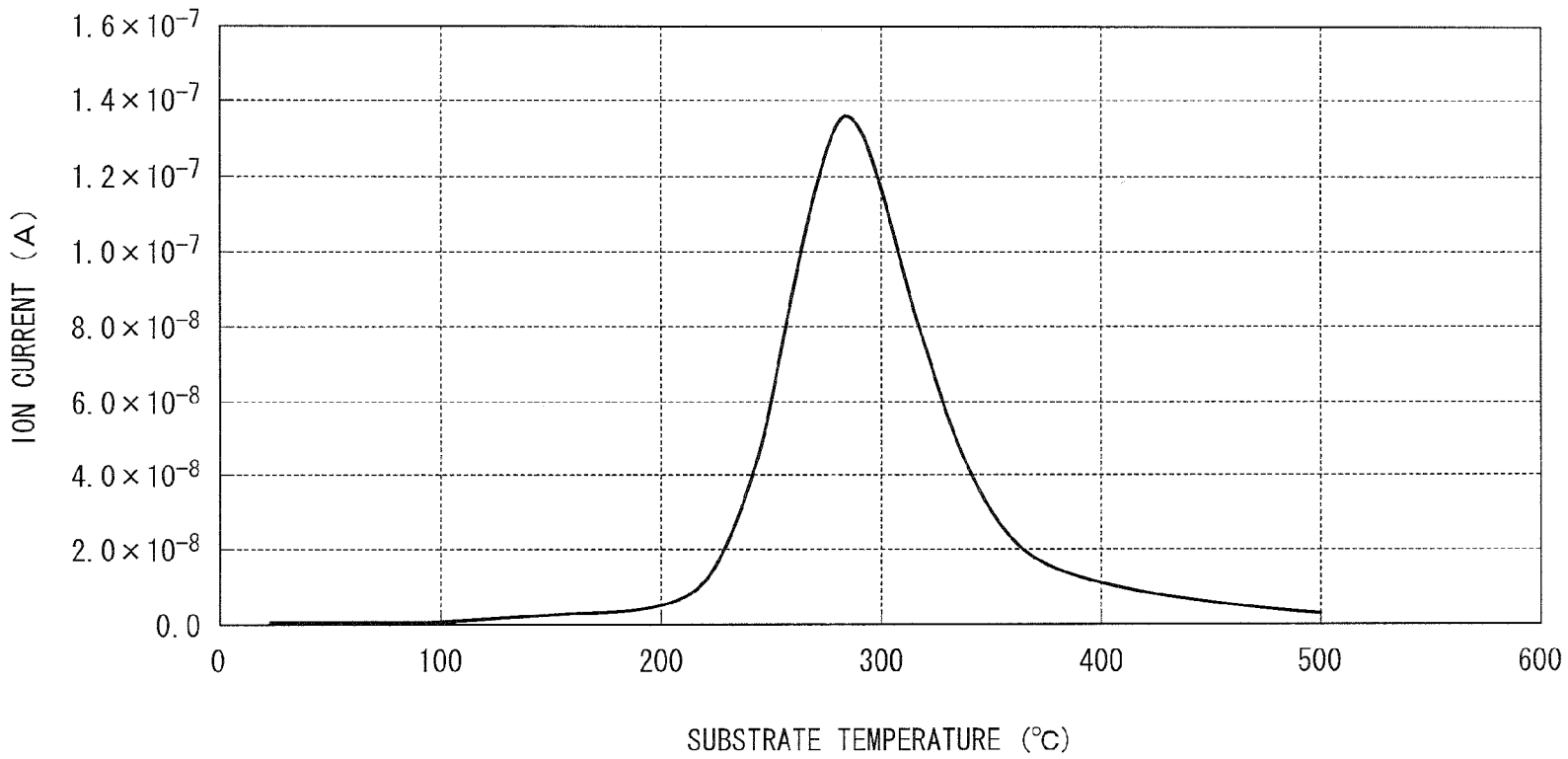
FIG. 8 is a graph showing an ion current value of carbon dioxide gas while heating a front substrate.

FIGS. 7 and 8 are graphs showing ion current of a specific gas (i.e., quantities corresponding to the partial pressure of a specific gas) measured by a residual gas analyzer while the front substrate was being heated. It is noted that the ion current value of the specific gas rises in proportion to the quantity of a specific gas released from the protective film. FIG. 7 shows the ion current value of water ($H_2O$; the mass charge ratio m/e=18), while FIG. 8 shows the ion current value of carbon dioxide gas ($CO_2$; the mass charge ratio m/e=44). In the case of the water shown in FIG. 7, it was found that, in the same way as in FIG. 6, a small peak was present at approximately 140° C., and a large peak was present at approximately 280° C. In the case of the carbon dioxide gas shown in FIG. 8, it was found that only a large peak was present at approximately 280° C.

From the results shown in FIG. 6 through FIG. 8, it is thought that the appearance of the peak at approximately 140° C. is due to releasing of water molecules which are weakly absorbed in the MgO. In addition, it is thought that the appearance of the peak at approximately 280° C. is due to degradation and releasing of magnesium hydroxycarbonate ($4MgCO_3.Mg(OH)_2.5H_2O$) formed from the MgO absorbing the carbon dioxide gas and water in the air.

Moreover, from the results shown in FIG. 6, it was found that if the front substrate 1 is heated beyond 280° C. where the large peak was confirmed, then 70% or more of the impurity gases absorbed in the protective film is released. Therefore, in the present embodiment, the front substrate 1 on which a protective film is formed is heated in a vacuum or in a controlled atmosphere to 280° C. or greater (a first deaeration step; S801).

Next, a rear substrate on which the phosphors and sealing material is formed is transported to the sealing chamber 82 shown in FIG. 5 while being held in a vacuum or controlled atmosphere, and is supported by the pin mechanism 92*a* provided in a bottom portion of the sealing chamber 82. The front substrate 1 and rear substrate 2 are then held at 280° C. or more in the vacuum or controlled atmosphere. Here, the two substrates may be heated to the sealing temperature. If the sealing temperature is less than 280° C., then the front substrate 1 alone may be heated to 280° C. or more.

Here, of the front substrate 1 and the rear surface 2 which have been positioned facing each other, it is necessary for the impurity gases released from one of the front substrate 1 and the rear surface 2, that are positioned facing each other, to be prevented from entering the other. Therefore, a carrier gas at a predetermined pressure is introduced between the front substrate 1 and the rear substrate 2 such that the mean free path of the impurity gases released from the substrates is shorter than the gap between the substrates. Here, the mean free path refers to the average of the distances particles travel where the particles freely moves in the gas and consecutively collides with particles of either the same type or different type. If a carrier gas is introduced, the mean free path becomes shorter since the released impurity gases collide with the carrier gas. If the mean free path of the impurity gases becomes shorter than the gap between the two substrates, it is possible to prevent impurity gases released from one substrate from entering the other substrate. Moreover, by introducing a carrier gas, it is possible to immediately exhaust the impurity gases released from one substrate.

$H_2$, $O_2$, $N_2$, Ar, Ne, Xe, CDA (clean dry air), and the like can be employed as the above described carrier gas to be introduced. In particular, it is desirable to employ the same type of electrical discharge gas as the electrical discharge gas sealed inside the PDP as the carrier gas. The reason for this is that, as is shown in FIG. 5, because the electrical discharge gas supply device 94 is provided in the sealing chamber 82, there is no need to provide a separate carrier gas supply device. Consequently, it is possible to suppress any increase in manufacturing costs. In this case, it may be arranged such that the electrical discharge gas supply device 94 and the evacuating system 95 are positioned facing each other, and electrical discharge gas supplied from the electrical discharge gas supply device 94 is able to pass between the two substrates 1 and 2 and be expelled by the evacuating system 95.

Next, the alignment step (S82) shown in FIG. 3 and the electrical discharge gas introduction and sealing step (S84) are performed. Specifically, in the sealing chamber 82 shown in FIG. 5, alignment marks on the front substrate 1 and rear substrate 2 are read by a CCD camera installed on the open air side of the chamber 90, and the two substrates 1 and 2 are positioned relative to each other (S82).

Next, electrical discharge gas is introduced by the electrical discharge gas supply device 94. Here, it is desirable that the electrical discharge gas including impurity gases of which the partial pressure is 2.0 Pa or less is introduced. In this case, it is possible to reduce the quantity of impurity gases contained inside the sealed panel.

Next, the hook mechanism 91*a* and the pin mechanism 92*a* are elongated inside the chamber such that the front substrate 1 and the rear substrate 2 are brought into contact with each other. While the two substrates 1 and 2 are in a compressed state, the sealing material 20 is heated to approximately 430 to 450° C. and the two substrates 1 and 2 are sealed together (S84). It may be arranged such that the sealing material 20 is heated to approximately 430 to 450° C., and then the hook mechanism 91*a* and the pin mechanism 92*a* are elongated inside the chamber so as to bring the front substrate 1 and the rear substrate 2 into contact with each other, and then the two substrates 1 and 2 are compressed so that they are sealed together. The panel obtained by this sealing is then transported to a cooling/unloading chamber shown in FIG. 4 where it is cooled to approximately 150° C. and is then unloaded.

It is desirable that the above described first deaeration step is performed until the density of the impurity gases inside the sealing chamber decreases to a predetermined value or less. Moreover, it is also desirable that the above described sealing step is performed while the density of the impurity gases inside the sealing chamber is maintained at a predetermined value or less. Specifically, the partial pressure of impurity gases such as $H_2$, $H_2O$, CO, $N_2$, and $CO_2$ inside the chamber 90 is measured using the residual gas analyzer 96 shown in FIG. 5 from the first deaeration step through to completion of the sealing step. It is particularly desirable to measure the partial pressure of $H_2O$ and $CO_2$. It is noted that when these measurements are being performed, by using a capillary or by driving a differential evacuating system connected to the residual gas analyzer 96, the pressure inside the analysis tube is prevented from increasing. In addition, when the partial pressure is to be reduced by the residual gas analyzer 96, calibration using He is performed in advance and the reduction coefficient is determined using the gas to be measured.

Here, in the first deaeration step, (1) a method which involves extending the heating time of the front substrate, or (2) a method which involves raising the heating temperature of the front substrate may be employed in order to accelerate the decrease in the density of the impurity gases. In the case of (2), there are reports that if the heating temperature is raised, for example, from 370° C. to 390° C., then the time required for lowering the density of the impurity gases to the predetermined value or less is shortened to approximately half. It is noted that the methods of both (1) and (2) may be employed at the same time.

In the present embodiment, the density of impurity gases inside the sealing chamber is reduced to 20 ppm or less. There are reports that if the density of the impurity gases is at least 20 ppm, then the operating voltage of an AC-type PDP is increased.

The sealing step is performed with the density of the impurity gases inside the sealing chamber being held at the predetermined value or less. For this reason, it is possible to lower the content of impurity gases inside a panel. Accordingly, it is possible to achieve either a reduction of the amount of the aging time or else to eliminate the aging step altogether. As a result, it is possible to achieve an improvement in throughput in manufacturing a PDP and to achieve an improvement in energy efficiency.

Figure 9A:
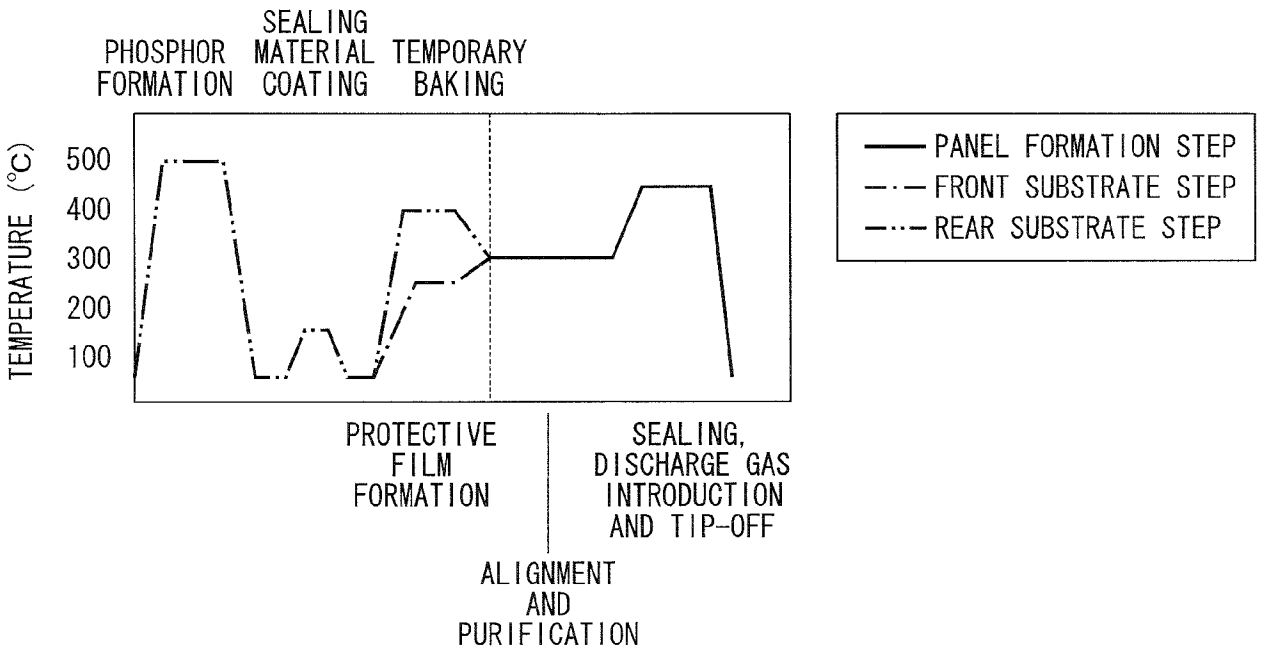
FIG. 9A is a graph showing change of temperature to which both substrates are heated in a PDP manufacturing process according to the embodiment.
Figure 9B:
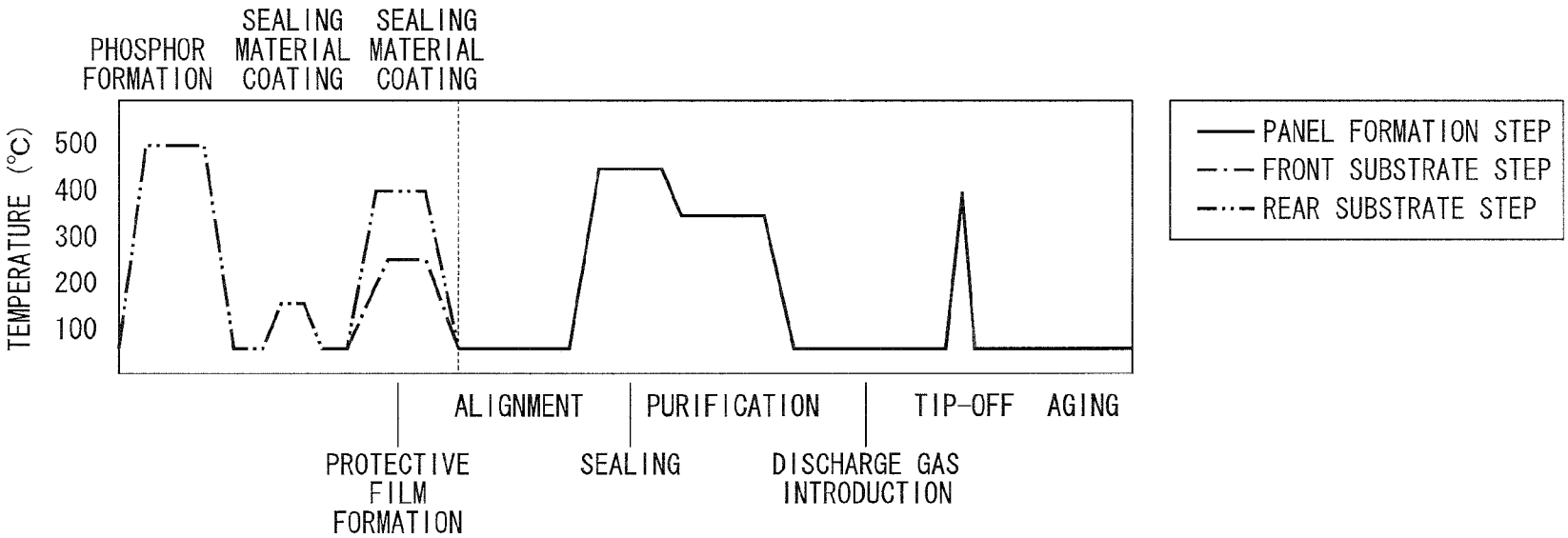
FIG. 9B is a graph showing change of temperature to which both substrates are heated in a PDP manufacturing process according to a conventional technology.

FIG. 9A and FIG. 9B are graphs showing changes of the temperatures for the two substrates 1 and 2 in a PDP manufacturing process. It is noted that FIG. 9A shows the case according to the present embodiment, while FIG. 9B shows the case according to the conventional technology. In the PDP manufacturing process according to the conventional technology which is shown in FIG. 9B, after the protective film is formed at approximately 250° C. in the front substrate step, the two substrates are aligned in the panel formation step at room temperature (i.e., in an air atmosphere). Subsequently, the two substrates are sealed together at approximately 450° C. in the panel formation step, and then the sealed substrates are purified at approximately 350° C. In this manner, in the conventional technology, since there are a number of heat cycles and there are large changes in temperature between steps, a huge amount of energy is consumed in a PDP manufacturing process, and this leads to a reduction in throughput.

In contrast, in the PDP manufacturing process according to the present embodiment which is shown in FIG. 9A, after the protective film is formed at approximately 250° C. in the front substrate step, purification of the two substrates by heating (i.e., the first deaeration step) and also alignment of the two substrates are both performed at 280° C. in the panel formation step. Subsequently, the two substrates are then sealed together at approximately 450° C. In this manner, since there are fewer heat cycles and fewer changes in temperature between steps in the present embodiment, it is possible to reduce the amount of energy which is consumed in a PDP manufacturing process compared with the conventional technology, and thereby achieve an improvement in throughput.

The inventors of the present invention performed aging experiments on PDP manufactured according to the conventional method and on PDP manufactured using the method according to the present embodiment and evaluated the initial characteristics. MgO having a film thickness of 800 nm was used for the protective film 14 of the PDP in the experiments, and Ne-4% Xe was introduced at a pressure of 66.5 kPa as the electrical discharge gas.

It is noted that in manufacturing a PDP according to the present embodiment, after a front substrate on which a protective film had been formed was heated in the sealing chamber to 280° C. (i.e., after it had undergone first deaeration processing), the two substrates were sealed together.

In contrast, in manufacturing a PDP according to the conventional technology, after a front substrate on which a protective film had been formed was kept in a vacuum for 120 minutes, the two substrates were laminated together and then sealed. It is noted that while the two substrates were being sealed, purification was performed for 90 minutes at 350° C.

Figure 10:
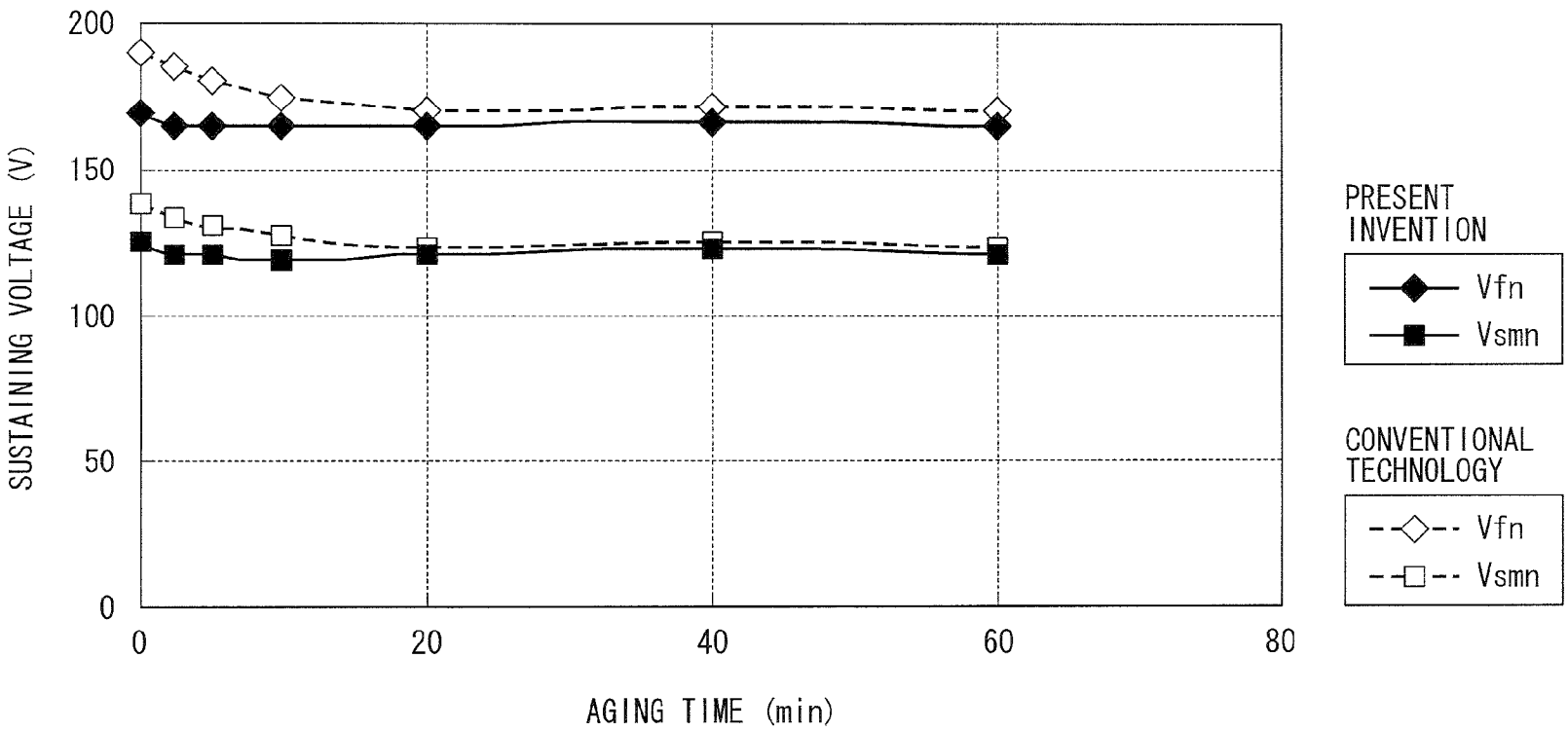
FIG. 10 is a graph showing results of aging tests.

FIG. 10 is a graph showing the results of the aging experiments. It is noted that Vfn is the lighting voltage of the last cell, Vsmn is the last off-light voltage. In the case of PDP which were manufactured using the conventional method and thus left in a vacuum (shown by the broken line graph in FIG. 10), both the lighting voltage of the last cell Vfn and the last off-light voltage Vsmn are high, and approximately 20 minutes are required until the voltage stabilizes. It is thought that this is because the impurity gases were not sufficiently released. In contrast, in the case of PDP which were manufactured using the method of the present embodiment (shown by the solid line graph in FIG. 10), both the lighting voltage of the last cell Vfn and the last off-light voltage Vsmn are low and are stable from the beginning. It is thought that this is because the impurity gases were sufficiently purified by the first deaeration processing.

From these results, it was confirmed that, by employing the PDP manufacturing method and manufacturing apparatus according to the present embodiment, it is possible to either reduce the amount of the aging time or else eliminate the aging step altogether. Accordingly, it is possible to improve throughput in manufacturing PDP. Moreover, it becomes possible to reduce power consumption which results in achieving an improvement in energy efficiency.

Further, the inventors of the present invention evaluated variations in characteristics after a period of time had elapsed for PDP manufactured using the method according to the present embodiment. Specifically, aging experiments were conducted in the manner described above after the PDP had been left for 48 hours in a temperature tank of 70° C.

Figure 11:
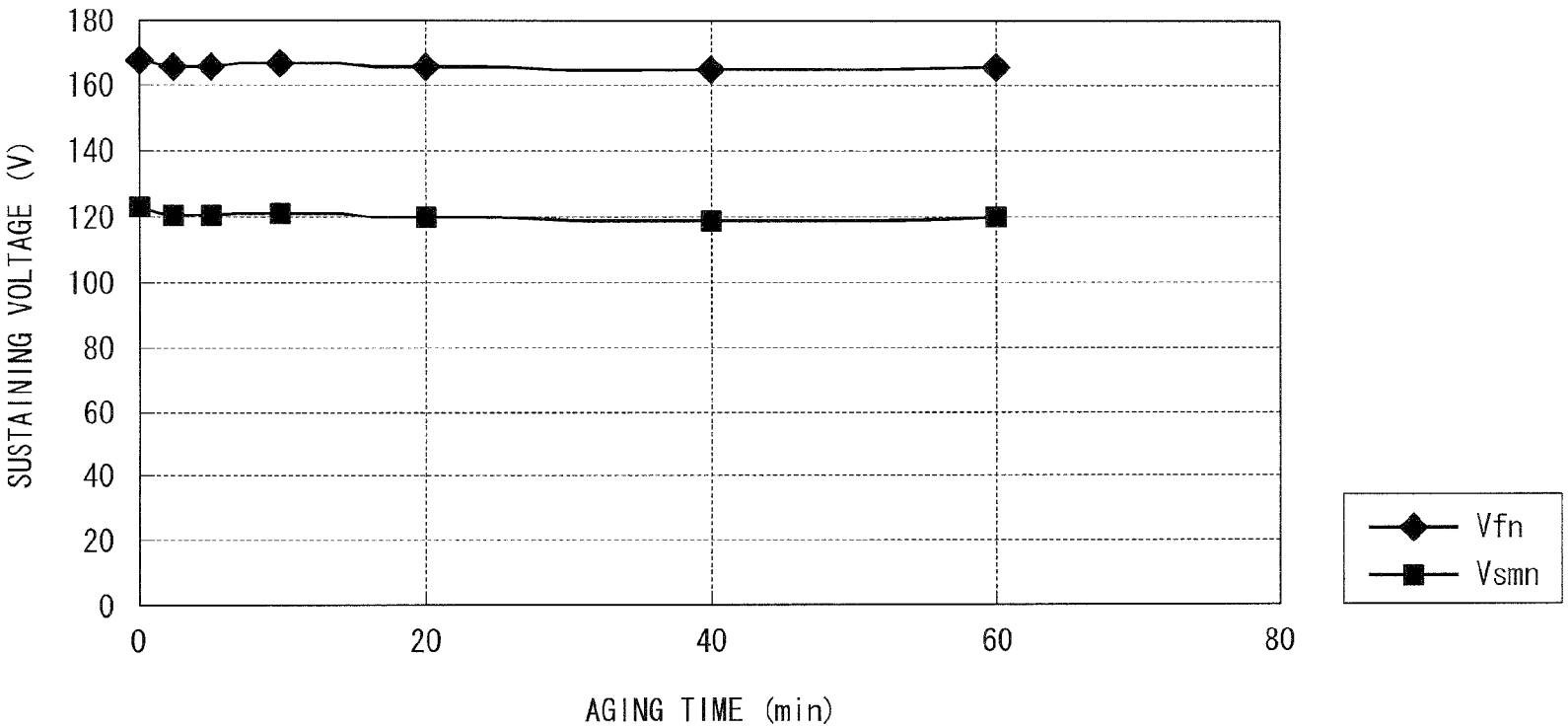
FIG. 11 is a graph showing results of aging test.

FIG. 11 is a graph showing the results of these aging experiments. In the PDP according to the present embodiment, the discharge voltage of the PDP shown in FIG. 11 which had been left for 48 hours exhibits substantially no change compared to the discharge voltage shown in FIG. 10 (i.e., the solid line). In contrast, in the PDP according to the conventional technology, because there was insufficient purification of the impurity gases, there was a rise in the discharge voltage after the PDP had been left for 48 hours.

From these results, it was confirmed that, since the impurity gases are sufficiently purified prior to sealing by the first deaeration processing in the PDP according to the present embodiment, there is a low content of impurity gases inside the panel and there is no a rise in the discharge voltage. Therefore, it is possible to achieve either a reduction of the amount of the aging time or else to eliminate the aging step altogether. In conjunction with this, it becomes possible to improve throughput in manufacturing PDP and achieve an improvement in energy efficiency.

As has been described in detail above, the PDP manufacturing method of the present embodiment has a first deaeration step in which impurity gases are released from a protective film by heating a front substrate, on which the protective film has been formed, to 280° C. or more in a vacuum or in a controlled atmosphere, and a sealing step in which the front substrate and a rear substrate are placed in contact with each other and sealed together consecutively from the first deaeration step.

According to the above described PDP manufacturing method, because impurity gases are released from a protective film while the exhaust conductance is large prior to the front substrate and rear substrate being placed in contact with each other, it is possible to perform purification in a short time. Accordingly, it is not necessary to perform purification during the sealing step. Moreover, since the protective film is heated to 280° C. or more, it is possible to release approximately 70% or more of the impurity gases absorbed in the protective film (see FIG. 6). Accordingly, it is possible to lower the content of impurity gases within a sealed panel. For this reason, it is possible to stabilize the discharge voltage of a panel, and thus achieve either a reduction of the amount of the aging time or else to eliminate the aging step altogether. Accordingly, it becomes possible to improve throughput in manufacturing PDP and achieve an improvement in energy efficiency.

Moreover, in the PDP manufacturing method of the present embodiment, after the protective film has been formed on the front substrate, the above described first deaeration step is performed while the front substrate is held in a vacuum or in a controlled atmosphere. Namely, the front substrate is held in a vacuum or in a controlled atmosphere from the protective film formation step through the first deaeration step.

In this case, since the impurity gases being absorbed into the protective film can be suppressed, it is possible to reduce the amount of the time required for the first deaeration step. Accordingly, it becomes possible to improve throughput in manufacturing PDP and achieve an improvement in energy efficiency.

Further, in the PDP manufacturing method of the present embodiment, the sealing step is performed after a second deaeration step in which, by heating a rear substrate on which phosphors and sealing material have been placed in a vacuum or in a controlled atmosphere, the impurity gases are released from the phosphors and sealing material.

In this case, since the quantity of impurity gases absorbed in the phosphors and sealing material can be reduced, the discharge voltage of the panel can be stabilized. Accordingly, it is possible to achieve either a reduction of the amount of the aging time or else to eliminate the aging step altogether which, as a result, makes it possible to improve throughput in manufacturing PDP and achieve an improvement in energy efficiency.

In the above described PDP manufacturing method, it is desirable that the above described second deaeration step is performed after the sealing material coating step of applying a sealing material onto the rear substrate in a vacuum or in a controlled atmosphere, and while the rear substrate is being held in the vacuum or in the controlled atmosphere. Namely, the rear substrate is held in a vacuum or in a controlled atmosphere from the sealing material coating step through to the completion of the second deaeration step.

In this case, it is possible to reduce the quantity of impurity gases absorbed in the sealing material. Accordingly, it is possible to achieve either a reduction of the amount of the aging time or else to eliminate the aging step altogether which, as a result, makes it possible to improve throughput in manufacturing PDP and achieve an improvement in energy efficiency.

Moreover, it is desirable to perform, prior to the above described sealing step, a step of preliminary heating the front substrate and rear substrate at a temperature equal to or greater than the sealing temperature in the sealing step.

Generally, the sealing temperature of the two substrates (i.e., the temperature at which the sealing material is dissolved) is approximately 420 to 430° C. According to the graph shown in FIG. 6, impurity gases are discharged even when the two substrates are heated to a temperature equal to or greater than the sealing temperature (it is thought that this is caused by gases released from the glass substrates). Therefore, preliminary heating is conducted on the front substrate and rear substrate at a temperature equal to or greater than the sealing temperature (for example, 450° C.) prior to the sealing step. This preliminary heating step can be performed either following the first deaeration step or simultaneously with the first deaeration step in the sealing chamber. For this reason, it is possible to perform the sealing in a state in which the quantities of impurity gases absorbed in the front substrate and rear substrate are reduced even further. Accordingly, it is possible to achieve either a reduction of the amount of the aging time or else to eliminate the aging step altogether which, as a result, makes it possible to improve throughput in manufacturing PDP and achieve an improvement in energy efficiency.

Second Embodiment

Next, a PDP manufacturing method and manufacturing apparatus according to a second embodiment of the present invention will be described.

The second embodiment differs from the first embodiment in that a preliminary deaeration step is provided between the protective film formation step and the first deaeration step for the front substrate. It is noted that any detailed description of component elements having the same structure as those in the first embodiment is omitted.

Figure 12:
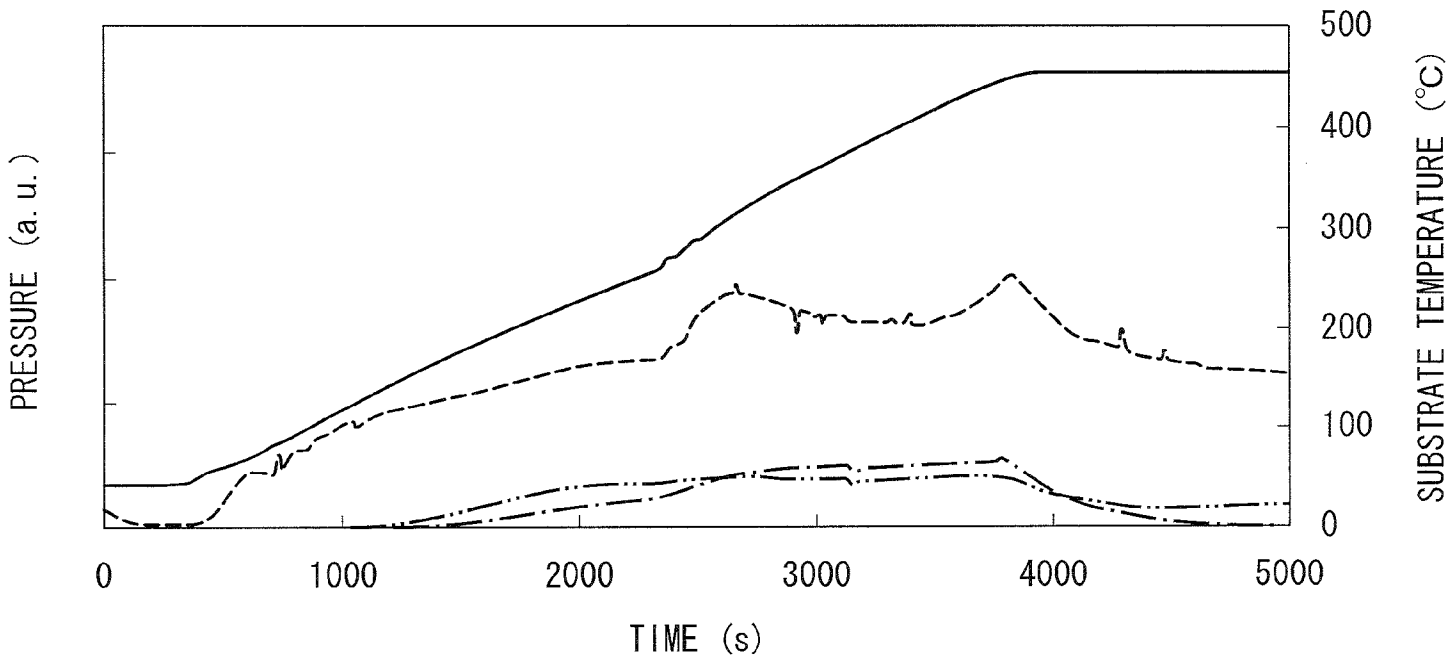
FIG. 12 is a graph showing measurement results of the released gas from the protective film using thermal desorption spectroscopy.

FIG. 12 is a graph showing measurement results of the released gas from the protective film using thermal desorption spectroscopy (TDS). In FIG. 12, a relationship between the heating time and the substrate temperature is shown by a solid line. Moreover, a relationship between the heating time and the pressure of the released gas in a case where (a) TDS was performed after a front substrate on which a protective film had been formed was held in a vacuum for 90 minutes is shown by a broken line. In addition, a relationship between the heating time and the pressure of the released gas in a case where (b) TDS was performed immediately after the formation of the protective film is shown by a single dot chain line. Further, a relationship between the heating time and the pressure of the released gas in a case where (c) TDS was performed after a front substrate on which a protective film had been formed was heated to 450° C. and was then held in a vacuum at 140° C. for 120 minutes is shown by a double dot chain line.

From the results in the case of (b), it was found that impurity gases were absorbed even in the protective film formation step. In addition, from a comparison of (b) and (a), it was found that when the substrate was held in a vacuum for 90 minutes there was a massive increase in the quantity of impurity gases absorbed. It is thought that all of the impurity gases were absorbed into the protective film while the protective was being formed, and that $H_2O$ was also absorbed into the protective film while the substrate was being held in the vacuum. In contrast, in the case of (c), it is thought that since impurity gases which had been absorbed into the protective film were released when the front substrate on which the protective film was formed was heated to 450° C., only the impurity gases which were absorbed when the substrate was held in a vacuum at 140° C. for 120 minutes were released.

From a more detailed comparison between (b) and (c), it is found that the quantity of released gas in the case of (b) is greater than that in the case of (c) in the region where the substrate temperature was approximately 280° C. or more. It is thought that this is because the magnesium hydroxycarbonate ($4MgCO_3.Mg(OH)_2.5H_2O$), which was generated by the reaction between the impurity gases which were absorbed during film formation (mainly $CO_2$) and the MgO, was degraded, and the $CO_2$ was released. Moreover, in the region where the substrate temperature was 200° C. or less, there was a greater quantity of released gas in the case of (c) than that in the case of (b). It is thought that this is because the $H_2O$ molecules which were weakly absorbed in the MgO due to the substrate being held in the vacuum for 120 minutes were released.

In this manner, it is thought that, only the impurity gases which were absorbed during the formation of the protective film were released in the case of (b), while only the impurity gases which were absorbed while the substrate was being held in a vacuum were released in the case of (c), and the impurity gases which were absorbed during both of these steps were released in the case of (a). However, the quantity of released gases in the case of (c) is smaller than the difference between those in the cases of (a) and (b). From these results, it is found that if a front substrate on which a protective film has been formed is heated, then it becomes difficult for impurity gases to be absorbed therein during the time in which it was subsequently held in a vacuum.

Moreover, the quantity of released gases in the case of (c) is ⅓ or less than that in the case of (a), and is at a level which does not cause any problems in a PDP. In particular, it is thought that the quantity of released gases in the case of (c) will be smaller than that in the case of (b) if the vacuum holding time in the case of (c) is shortened. Therefore, in the present embodiment, the method of (c) is employed.

Figure 13:
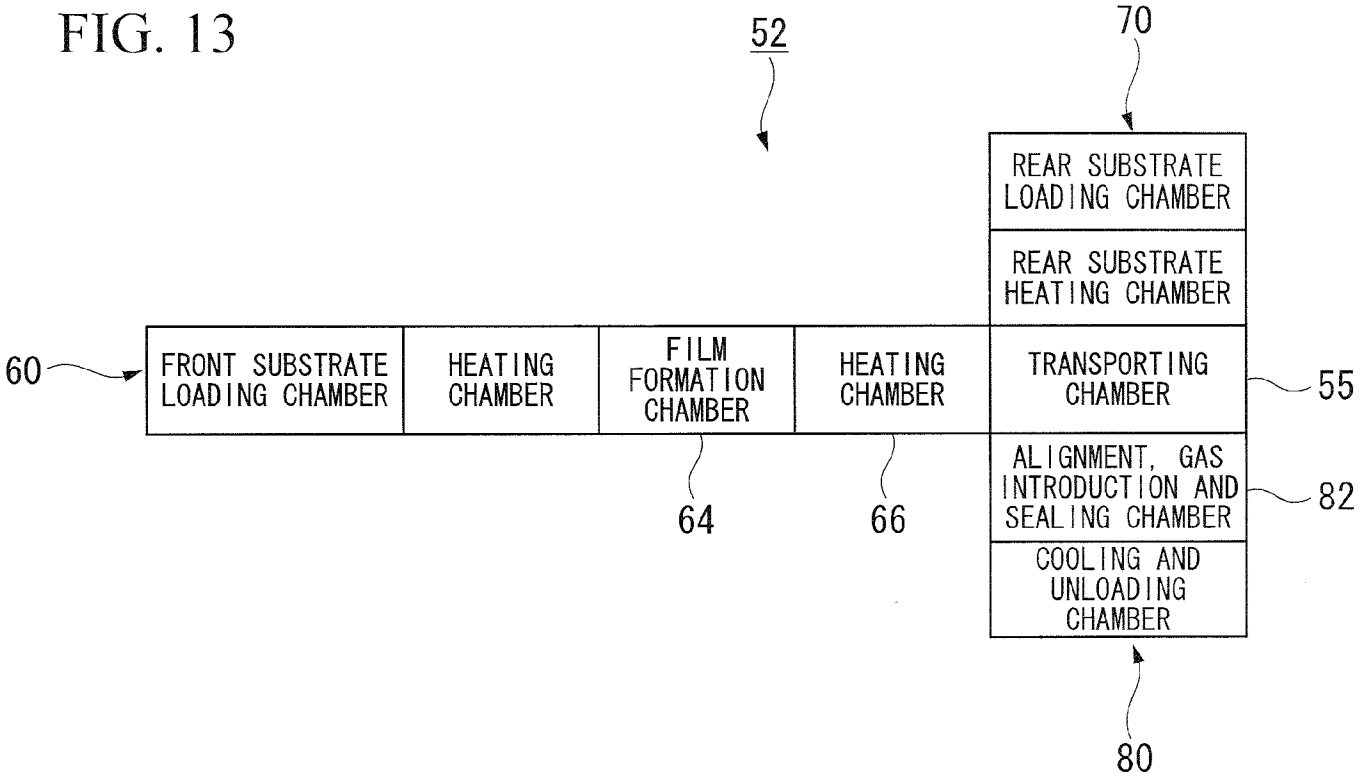
FIG. 13 is a block diagram showing a PDP manufacturing apparatus according to a second embodiment.

FIG. 13 is a block diagram of a PDP manufacturing apparatus according to the second embodiment. The PDP manufacturing apparatus 52 according to the second embodiment differs from the PDP manufacturing apparatus 50 according to the first embodiment which is shown in FIG. 4 in that a heating chamber 66 is provided on the downstream side of the film formation chamber 64 on the front substrate line 60.

In the PDP manufacturing method according to the second embodiment, a protective film formation step is performed in the same way as in the first embodiment. Specifically, a protective film is formed on the front substrate in the film formation chamber 64 shown in FIG. 13. Next, the front substrate is heated to 350° C. or more in the heating chamber 66 while the front substrate, on which the protective film has been formed, remains held in a vacuum (preliminary deaeration step).

As is described above, magnesium hydroxycarbonate is generated in the protective film as a result of the reaction between impurity gases absorbed during the formation of the protective film and MgO. By then heating the front substrate on which the protective film has been formed to 350° C. or more, the magnesium hydroxycarbonate is reliably degraded, and thus the impurity gases (mainly $CO_2$) which have been absorbed in the protective film can be reduced. Moreover, impurities such as $H_2$, C, $H_2O$, CO, and $CO_2$ are taken in during the formation of the protective film, however, these impurity gases can be removed by heating the front substrate to 350° C. or more in the preliminary deaeration step. According to the graph shown in FIG. 6, by heating the front substrate to 350° C. or more, 90% or more of the impurity gases can be released from the protective film.

Next, the front substrate which has finished the heating step is transported to the sealing chamber 82 via the transporting chamber 55 while being kept in a vacuum. It is desirable for the front substrate to be kept at 100° C. or more while it is being transported. In the sealing chamber 82 shown in FIG. 5, in the same way as in the first embodiment, the front substrate 1 is supported by the hook mechanism 91*a*. The front substrate 1 is then heated to 280° C. or more by the heater plate 91 in a vacuum or in a controlled atmosphere (i.e., the first deaeration step). Therefore, any impurity gases which are absorbed in the protective film while the front substrate is being transported in a vacuum are released.

Thereafter, the rear substrate 2 on which the phosphors and sealing material have been formed is transported to the sealing chamber 82 where it and the front substrate 1 are sealed together.

It is noted that the above described preliminary deaeration step may be performed prior to the front substrate and the rear substrate being placed in contact with each other in the sealing chamber 82. Since the melting temperature of the sealing material applied on the rear substrate is currently between approximately 380 to 500° C., the sealing material does not melt even if it is heated to 350° C. However, there is a possibility that the melting temperature of future sealing materials will be less than 350° C. In this case, as in the present embodiment, it is desirable for the preliminary heating step to be performed in a heating chamber 66 which is provided separately from the sealing chamber 82.

As has been described in detail above, the PDP manufacturing method according the second embodiment has a preliminary deaeration step of releasing impurity gases from a protective film by heating a front substrate, on which the protective film has been formed, to 350° C. or more in a vacuum, and a first deaeration step in which the front substrate which has completed the preliminary deaeration step is heated to 280° C. or more while being kept in a vacuum. Namely, the front substrate is kept in a vacuum from the preliminary deaeration step through the first deaeration step.

According to the above described PDP manufacturing method, it is possible to release any impurity gases which have been absorbed during the formation of the protective film in the preliminary deaeration step, and it is possible to suppress any new impurity gases being absorbed while the first substrate is held in a vacuum. Therefore, it becomes possible to achieve the same impurity gas absorption level as that immediately after the formation of the protective film (see FIG. 12). Accordingly, it is possible to reduce the amount of the purification time. Moreover, since the quantity of impurity gases contained within a panel is reduced to stabilize the discharge voltage, it is possible to achieve either a reduction in the amount of the aging time or else to eliminate the aging step altogether. Accordingly, improvements in throughput in manufacturing PDP and in energy efficiency can be achieved. Moreover, since the first substrate can be in a waiting state between the protective film formation step and the sealing step, flexible step design becomes possible which results in an even more improved throughput in manufacturing PDP.

It should be noted that the tact time for the protective film formation step in the film formation chamber 64 is extremely short compared to the tact time for the panel formation step in the sealing chamber 82. Because of this, the waiting (i.e., standby) time of the front substrate after the protective film formation becomes long. Therefore, by performing the above described preliminary deaeration step while the front substrate is in a waiting state, any reduction of the throughput in manufacturing PDP can be prevented. Moreover, it is also possible to leave the front substrate in a waiting state in the heating chamber after the preliminary deaeration step has been completed. In addition, since the preliminary deaeration step is performed, even if the front substrate is left alone after the step for a considerable time, it is still possible to suppress any absorption of impurity gases. As a result, it is possible to either reduce the amount of the time required for the aging step or else to eliminate the aging step altogether.

Third Embodiment

Next, a PDP manufacturing method and manufacturing apparatus according to a third embodiment of the present invention will be described.

In the above described PDP manufacturing method according to the second embodiment, the preliminary deaeration step is performed in a vacuum. In contrast, in the PDP manufacturing method according to the third embodiment, the preliminary deaeration step is performed in an air atmosphere or in a controlled atmosphere. It is noted that any detailed description of component elements having the same structure as those in the first embodiment or second embodiment is omitted.

As in the above described second embodiment, if the preliminary deaeration step is performed in a vacuum, it is possible to vastly reduce the quantity of impurity gases which are absorbed in the protective film. However, if (A) the preliminary deaeration step is performed in an air atmosphere (i.e., in an atmosphere in which oxygen is present) or in a controlled atmosphere, compared with (B) a case where the preliminary deaeration step is not performed, it is still possible to reduce the absorption quantity of impurity gases. Specifically, front substrates in the cases of (A) and (B) were left for 30 minutes in an air atmosphere having a relative humidity of 50%, and the released gas quantity was then measured by performing TDS. As a result, it was found that the quantity of released gas from the substrate (A) was approximately 30% less compared to the substrate (B).

In addition, it is possible to improve the crystallinity of the protective film in the case of (A) compared to (B). Specifically, the (111) peak intensity increases and the half value width decreases. Moreover, it is possible to greatly improve the electric discharge delay after panel formation.

In addition, if the preliminary deaeration step is performed in an air atmosphere, then there is no longer any need to perform the sealing step immediately after the protective film formation step so that the process is provided with a degree of flexibility.

Figure 14:
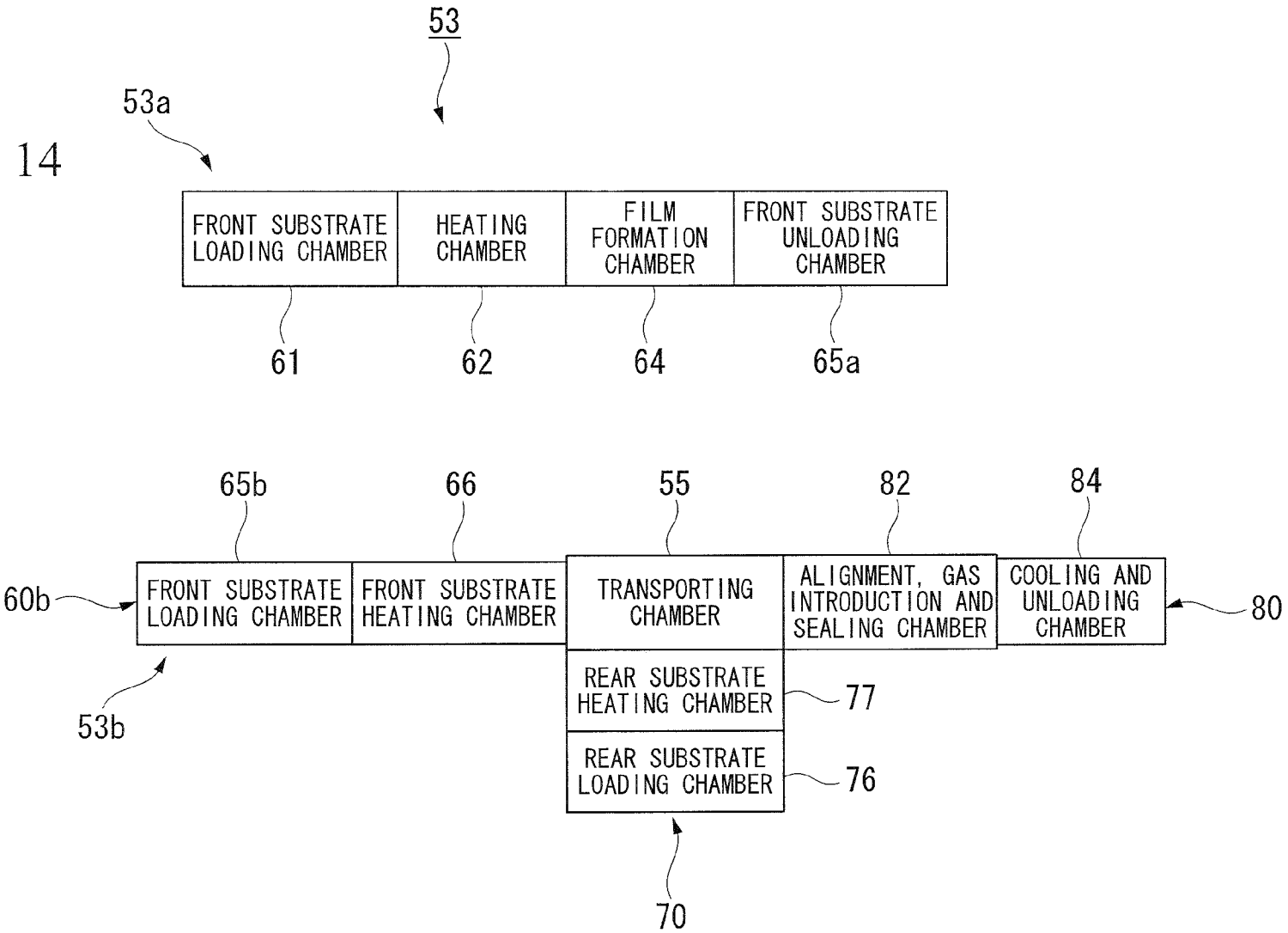
FIG. 14 is a block diagram showing a PDP manufacturing apparatus according to a third embodiment.

FIG. 14 is a block diagram of a PDP manufacturing apparatus according to the third embodiment. A PDP manufacturing apparatus 53 according to the third embodiment is divided into a protective film formation apparatus 53*a* and a panel formation apparatus 53*b*. The protective film formation apparatus 53*a* is provided with a front substrate loading chamber 61, a heating chamber 62 which heats the front substrate to approximately 150 to 350° C., a film formation chamber 64 where a protective film is formed using an electron beam evaporation method, and an unloading chamber 65*a* where the front substrate is unloaded.

On the other hand, in the panel formation apparatus 53*b*, a rear end of a front substrate line 60*b*, a rear end of the rear substrate line 70, and a front end of the panel formation line 80 are connected to the transporting chamber 55. The rear substrate line 70 and the panel formation line 80 have the same structure as in the first embodiment. In contrast, the front substrate line 60*b* is provided only with the front substrate loading chamber 61 and the heating chamber 66, and is not provided with a film formation chamber.

In the PDP manufacturing method according to the third embodiment, the protective film formation step is performed in the film formation chamber 64 of the protective film formation apparatus 53*a*. After the front substrate has been unloaded from the protective film formation apparatus 53*a*, it is heated in an air atmosphere to 350° C. or more in a heating apparatus (not shown) (i.e., the preliminary deaeration step). Next, the front substrate is loaded into the loading chamber 65*b* of the panel formation apparatus 53*b*, and is placed in a waiting state either in a vacuum or in a controlled atmosphere in the heating chamber (i.e., a buffer chamber) 66.

Next, the front substrate is transported to the sealing chamber 82. In the same way as in the first embodiment, the front substrate 1 is then supported by the hook mechanism 91*a* provided in the top portion of the sealing chamber 82 shown in FIG. 5, and the front substrate 1 is then heated to 280° C. or more by the heater plate 91 either in a vacuum or in a controlled atmosphere (i.e., the first deaeration step). As a result, impurity gases which have been absorbed in the protective film of the front substrate are released.

Thereafter, the rear substrate 2 on which the phosphors and sealing material have been formed is transported to the sealing chamber 82 where the rear substrate 2 and the front substrate 1 are sealed together.

As has been described in detail above, the PDP manufacturing method according to the third embodiment has a preliminary deaeration step in which impurity gases are released from a protective film by heating a front substrate, on which the protective film has been formed, to 350° C. or more in an air atmosphere or in a controlled atmosphere, and a first deaeration step in which the front substrate is heated to 280° C. or more while being kept in a vacuum or in a controlled atmosphere.

According to the above described PDP manufacturing method, by heating the first substrate to 350° C. or more, it becomes possible to release any impurity gases absorbed during the formation of the protective film. In addition, since it is possible to suppress any new impurity gases being absorbed while the first substrate is in a waiting state, the purification time can be shortened. Moreover, since the quantity of impurity gases contained within a panel can be reduced, and the discharge voltage can also be stabilized, it is possible to achieve either a reduction of the amount of the aging time or else to eliminate the aging step altogether. Accordingly, it becomes possible to improve throughput in manufacturing PDP and achieve an improvement in energy efficiency. In addition, since heating in an air atmosphere can be performed at low cost, manufacturing costs can be reduced.

The tact time for the protective film formation step in the film formation chamber 64 shown in FIG. 14 is extremely short compared to the tact time for the panel formation step in the sealing chamber 82. Therefore, it is desirable to provide a plurality of panel formation apparatuses 53*b* for each protective film formation apparatus 53*a*. In the present embodiment, since it is not necessary for a front substrate to be transported from the protective film formation apparatus 53*a* to the panel formation apparatus 53*b* in a vacuum or in a controlled atmosphere, it is possible to provide an optional plurality of panel formation apparatuses 53*b*. In this manner, according to the present embodiment, flexible step design becomes possible which results in improving the throughput in manufacturing PDP to the maximum possible level.

It should be noted that the range of technology of the present invention is not limited to the above described embodiments, and various modifications can be made to the above described embodiments insofar as they do not depart from the spirit or scope of the present invention.

Namely, the specific materials and structure and the like described in the respective embodiments are simply an example thereof, and appropriate modifications may be made thereto.

For example, in the above described embodiments, a description is given using a protective film formed from MgO as an example, however, the present invention can be applied in the same way to protective films formed from oxides of alkaline earth metals such as SrO and CaO, or from other materials.

INDUSTRIAL APPLICABILITY

It is possible to provide method and apparatus for manufacturing a plasma display panel, which make it possible to achieve an improvement in throughput and a reduction in energy consumption.

What is claimed is:

1. A method for manufacturing a plasma display panel in which an electrical discharge gas is introduced into a space between a first substrate and a second substrate which are sealed together, the method comprising:

a first deaeration step of releasing impurity gases from a protective film by heating the first substrate, on which the protective film is formed for withstanding plasma electrical discharge, to 280° C. or more in a vacuum or in a controlled atmosphere in a sealing chamber; and a sealing step of sealing the first substrate and the second substrate together in the sealing chamber by placing the first substrate and the second substrate in contact with each other and heating the first substrate and the second substrate in the sealing chamber subsequently after the heating in the first deaeration step, wherein in the first deaeration step, when the first substrate and the second substrate are positioned facing each other, a carrier gas is introduced between the first substrate and the second substrate such that a mean free path of the impurity gases released from either the first substrate or the second substrate is shorter than the gap between the first substrate and the second substrate, and the carrier gas is the same type of gas as the electrical discharge gas.

2. The method for manufacturing a plasma display panel according to claim 1, the method further comprising a protective film formation step of forming the protective film on the first substrate either in a vacuum or in a controlled atmosphere prior to the first deaeration step, wherein the first substrate is held in the vacuum or in the controlled atmosphere from the protective film formation step through the first deaeration step.

3. The method for manufacturing a plasma display panel according to claim 1, the method further comprising a preliminary deaeration step of releasing impurity gases from the protective film by heating the first substrate, on which the protective film is formed, to 350.degree. C. or more in a vacuum prior to the first deaeration step, wherein the first substrate is held in the vacuum from the preliminary deaeration step through the first deaeration step.

4. The method for manufacturing a plasma display panel according to claim 1, the method further comprising a preliminary deaeration step of releasing impurity gases from the protective film by heating the first substrate, on which the protective film has been formed, to 350.degree. C. or more in an air atmosphere or in a controlled atmosphere prior to the first deaeration step.

5. The method for manufacturing a plasma display panel according to claim 1, wherein the sealing step is performed while the density of impurity gases in the atmosphere is held at a predetermined value or less.

6. The method for manufacturing a plasma display panel according to claim 1, the method further comprising a second deaeration step of releasing impurity gases from phosphors and a sealing material by heating the second substrate, on which the phosphors and the sealing material are placed, in a vacuum or in a controlled atmosphere prior to the sealing step.

7. The method for manufacturing a plasma display panel according to claim 6, the method further comprising a sealing material coating step of applying a sealing material onto the second substrate either in a vacuum or in a controlled atmosphere prior to the second deaeration step, wherein the second substrate is held in the vacuum or in the controlled atmosphere from the sealing material coating step through the second deaeration step.

8. The method for manufacturing a plasma display panel according to claim 1, wherein, in the sealing step, the electrical discharge gas is introduced such that the partial pressure of the impurity gases is 2.0 Pa or less.

9. The method for manufacturing a plasma display panel according to claim 1, the method further comprising a step of preliminary heating the first substrate and the second substrate in a vacuum or in a controlled atmosphere to a temperature equal to or greater than the sealing temperature in the sealing step, prior to the sealing step.

* * * * *